US012553239B2

(12) United States Patent
Wilsey et al.

(10) Patent No.: US 12,553,239 B2
(45) Date of Patent: Feb. 17, 2026

(54) BUILDING METHOD

(71) Applicant: NuRoc Engineering Technologies, LLC, Pagosa Springs, CO (US)

(72) Inventors: Mark E. Wilsey, Pagosa Springs, CO (US); Marcos Gonzalez, Ocoee, FL (US)

(73) Assignee: NuRoc Engineering Technologies, LLC, Pagosa Springs, CO (US)

( * ) Notice: Subject to any disclaimer, the term of this patent is extended or adjusted under 35 U.S.C. 154(b) by 176 days.

(21) Appl. No.: 17/687,456

(22) PCT Filed: Jul. 23, 2020

(86) PCT No.: PCT/US2020/043263
§ 371 (c)(1),
(2) Date: Mar. 4, 2022

(87) PCT Pub. No.: WO2021/045849
PCT Pub. Date: Mar. 11, 2021

(65) Prior Publication Data

US 2022/0412085 A1 Dec. 29, 2022

Related U.S. Application Data

(60) Provisional application No. 62/895,837, filed on Sep. 4, 2019.

(51) Int. Cl.
*E04C 2/32* (2006.01)
*E04C 2/16* (2006.01)

(52) U.S. Cl.
CPC ..... *E04C 2/328* (2013.01); *E04C 2/16* (2013.01)

(58) Field of Classification Search
CPC ..... E04C 2/328; E04C 2/16
(Continued)

(56) References Cited

U.S. PATENT DOCUMENTS 2,170,655 A * 8/1939 Fourness ..... E04C 2/16 428/184
2,267,912 A * 12/1941 Hain ..... E04B 1/32 52/80.1

(Continued)

FOREIGN PATENT DOCUMENTS

GB 2075082 A * 11/1981 ..... E04B 1/164
KR 20160103682 A * 9/2016

OTHER PUBLICATIONS

The Inernational Bureau of WIPO, International Preliminary Report on Patentability and Written Opinion issued in International Application No. PCT/US2020/043263, mailed Mar. 17, 2022 (12 pages).

(Continued)

*Primary Examiner* — Brian D Mattei
*Assistant Examiner* — Joseph J. Sadlon
(74) *Attorney, Agent, or Firm* — The Marbury Law Group, PLLC

(57) ABSTRACT

A method of fabricating a structure including hanging a flexible fabric in a substantially vertical direction, shielding a portion of the flexible fabric and applying a fixative to an unshielded portion of the flexible fabric, thereby forming a fixed portion of the flexible fabric. A shielded portion of the flexible fabric is located in a portion of the fabric and is configured to act as a hinge allowing the fixed portion to be rotated.

53 Claims, 18 Drawing Sheets

(58) Field of Classification Search
USPC ..... 52/80.1
See application file for complete search history.

(56) References Cited

U.S. PATENT DOCUMENTS

D171,889 S * 4/1954 Graham ..... 52/80.1
2,812,769 A * 11/1957 Schaefer ..... E04H 15/20 52/2.21
3,113,788 A * 12/1963 Johnston ..... B29C 70/46 428/218
3,139,464 A * 6/1964 Bird ..... E04G 11/04 264/32
3,225,413 A * 12/1965 Bird ..... E04G 11/045 425/440
3,231,644 A * 1/1966 Chang ..... E04G 21/0472 52/80.1
3,232,806 A * 2/1966 Widmer ..... E04B 1/35 156/247
3,257,481 A * 6/1966 Chang ..... E04B 1/169 264/45.2
3,299,585 A * 1/1967 Wilkins ..... E04B 7/102 52/80.1
3,506,746 A * 4/1970 Fontaine ..... E04G 11/04 52/80.1
3,557,515 A * 1/1971 MacCracken ..... E04G 11/045 52/80.1
3,618,886 A * 11/1971 Graham ..... B29C 33/308 249/155
3,619,432 A * 11/1971 Harrington ..... E04G 11/04 D25/19
3,667,173 A * 6/1972 Billgren ..... E04B 7/14 52/80.1
3,998,015 A * 12/1976 Scott ..... E04C 2/043 52/406.1
4,016,702 A * 4/1977 Nakada ..... E04B 1/169 52/742.13
4,253,288 A * 3/1981 Chun ..... E04B 2/845 264/46.7
4,265,961 A * 5/1981 Bena ..... E04B 1/164 156/247
4,279,680 A * 7/1981 Watson, Jr. ..... E04B 1/3211 264/225
4,361,612 A * 11/1982 Shaner ..... E04C 2/16 428/326
4,361,995 A * 12/1982 Buck ..... B28B 23/0006 52/631
4,550,533 A * 11/1985 Fraioli ..... E04H 15/22 52/80.1
4,594,470 A * 6/1986 Headrick ..... F24S 50/60 353/3
4,597,925 A * 7/1986 Loggy ..... E04B 1/166 52/741.15
4,678,157 A * 7/1987 Fondiller ..... E04G 11/045 52/749.13
4,683,689 A * 8/1987 Loggy ..... E04B 7/102 52/80.1
4,683,696 A * 8/1987 Thoeny ..... E04B 1/164 52/249
4,704,837 A * 11/1987 Menchetti ..... E04C 2/043 52/273
4,723,751 A * 2/1988 Hale ..... E04G 11/045 264/32
4,799,982 A * 1/1989 Vicino ..... B28B 7/22 264/45.2
4,831,699 A * 5/1989 Rozzi ..... B21F 27/121 52/249
4,886,084 A * 12/1989 Lawrence ..... E04H 15/18 52/471
4,894,270 A * 1/1990 Nicholls ..... B28B 1/32 138/146
4,988,543 A * 1/1991 Houle ..... B05C 1/06 427/372.2
5,119,606 A * 6/1992 Graham ..... E04C 2/521 52/125.4
5,240,533 A * 8/1993 Bottger ..... D06N 3/0022 442/205
5,273,803 A * 12/1993 Metcalf ..... B29C 33/3892 264/46.7
5,361,550 A * 11/1994 Kaden ..... E04B 1/3211 52/80.1
5,366,801 A * 11/1994 Bryant ..... D06N 3/14 428/313.5
5,425,207 A * 6/1995 Shayman ..... E04C 2/043 52/270
5,592,796 A * 1/1997 Landers ..... E04B 2/7457 52/483.1
5,803,964 A * 9/1998 Scarborough ..... E04B 1/161 106/737
6,063,507 A * 5/2000 Blumel ..... E04C 2/32 219/91.21
6,110,575 A * 8/2000 Haga ..... E04C 2/043 428/921
6,235,367 B1 * 5/2001 Holmes ..... E04B 1/14 52/309.7
6,330,777 B1 * 12/2001 Padley ..... B21D 47/04 108/51.11
6,434,908 B1 * 8/2002 Ferrante ..... E04B 2/82 52/669
6,718,722 B2 * 4/2004 Worrell ..... E04B 2/845 52/DIG. 9
6,851,228 B1 * 2/2005 Forman ..... E04H 4/0018 52/80.1
6,880,298 B2 * 4/2005 Davies ..... E04B 1/3211 52/80.1
6,886,304 B1 * 5/2005 Godi ..... C04B 26/18 52/311.1
7,506,483 B2 * 3/2009 Thoeny ..... E04H 15/20 52/745.15
7,591,108 B2 * 9/2009 Tuczek ..... E04B 7/102 52/80.1
7,694,479 B2 * 4/2010 Killen ..... E04C 2/328 52/309.4
7,721,749 B2 * 5/2010 Brewin ..... E04B 1/169 52/80.1
7,743,578 B2 * 6/2010 Edmondson ..... E04B 1/24 52/653.1
8,002,943 B2 * 8/2011 Brown ..... B28B 11/0845 52/747.11
8,484,918 B2 * 7/2013 Merkel ..... B29C 70/025 52/309.3
8,668,974 B2 * 3/2014 Purdy ..... B29D 99/0089 428/36.4
8,739,792 B2 * 6/2014 Holley ..... E04B 1/3205 52/80.1
8,789,317 B2 * 7/2014 Cheh ..... D04H 3/04 52/80.1
8,863,443 B2 * 10/2014 Dalo ..... E04B 7/14 52/80.1
8,973,336 B2 * 3/2015 Edwards ..... E04B 7/08 52/80.1
9,010,070 B2 * 4/2015 Darr, III ..... E04B 2/789 52/653.1
9,695,602 B2 * 7/2017 Shaw ..... E04F 15/126
9,951,519 B2 * 4/2018 Neil ..... E04B 1/66
10,139,114 B2 * 11/2018 Wójcik ..... F28D 15/06
2001/0000517 A1 4/2001 Zuckerman et al.
2001/0023561 A1 * 9/2001 Henbid ..... E04H 15/18 52/80.1
2002/0100228 A1 * 8/2002 Yoder ..... B29C 48/07 52/80.1
2003/0051418 A1 * 3/2003 Crowder ..... E04H 9/14 52/80.1
2005/0284088 A1 * 12/2005 Heath ..... E04B 2/845 52/741.1
2006/0277830 A1 12/2006 Boggs, Jr.
2009/0145046 A1 * 6/2009 Thoeny ..... E04H 15/20 52/80.1

(56) References Cited

U.S. PATENT DOCUMENTS

| | | | | |
|---|---|---|---|---|
| 2010/0012004 | A1* | 1/2010 | Telander | B32B 5/024 428/328 |
| 2010/0199574 | A1* | 8/2010 | Perlatti | E04D 13/08 52/12 |
| 2015/0052827 | A1* | 2/2015 | DaCosta | E04B 7/10 52/80.1 |
| 2017/0145692 | A1* | 5/2017 | Zheng | B28B 5/028 |
| 2017/0274556 | A1* | 9/2017 | Gardiner | E04C 2/041 |
| 2018/0183383 | A1* | 6/2018 | Lomasney | H02S 40/425 |
| 2018/0347183 | A1* | 12/2018 | Santi | E04B 1/94 |
| 2020/0115898 | A1* | 4/2020 | Zeenni | E04B 2/48 |
| 2021/0207378 | A1* | 7/2021 | Dzenis | B32B 7/12 |

OTHER PUBLICATIONS

Korean Intellectual Property Office, International Search Report and Written Opinion, issued in International Application No. PCT/US2020/043263 mailed Oct. 30, 2020 (17 Pages).

* cited by examiner

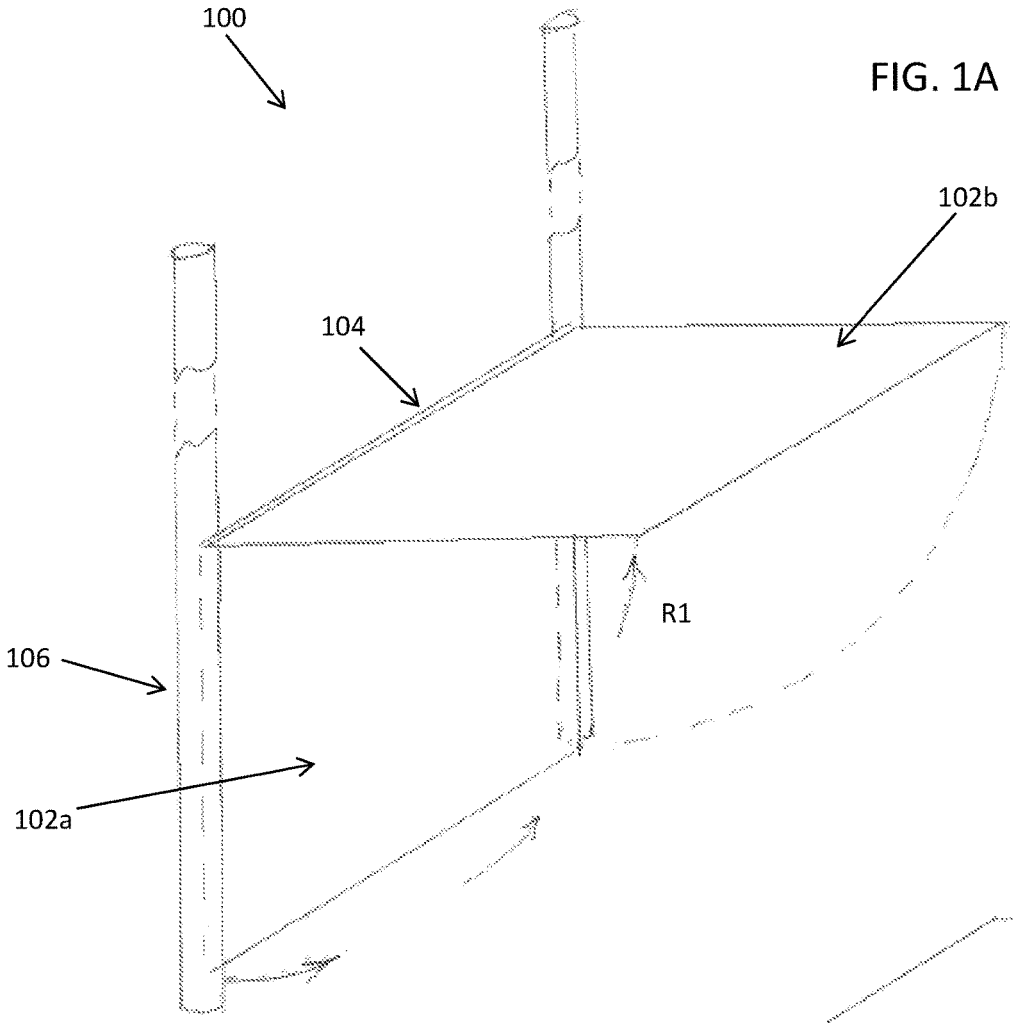
FIG. 1A
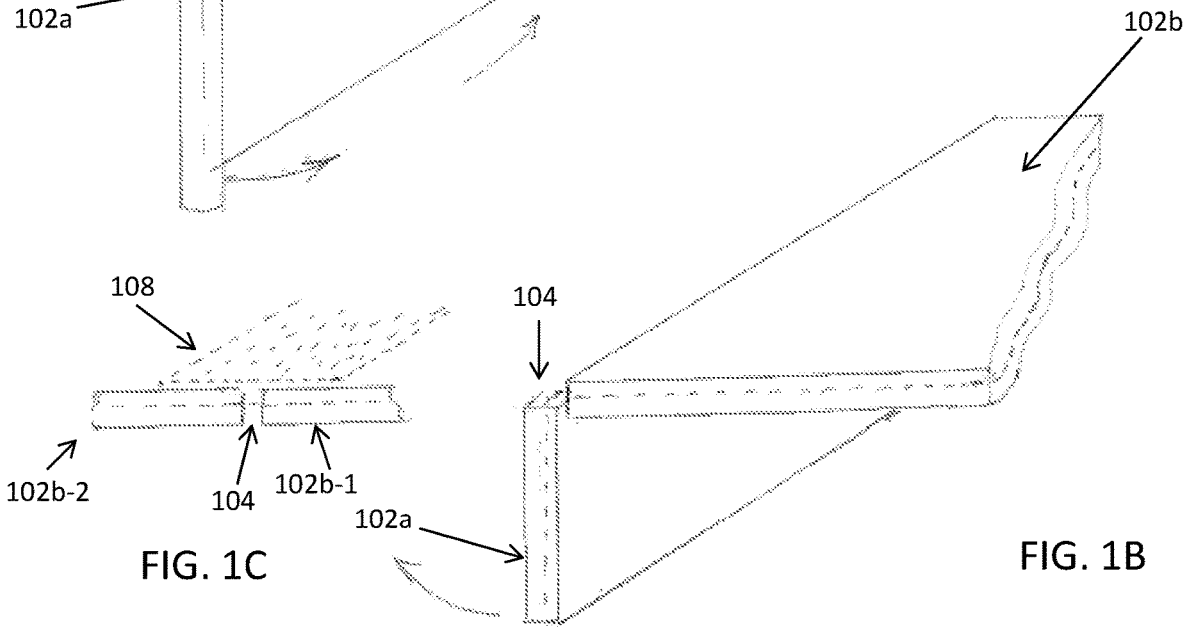
FIG. 1B
FIG. 1C

FIG. 13A
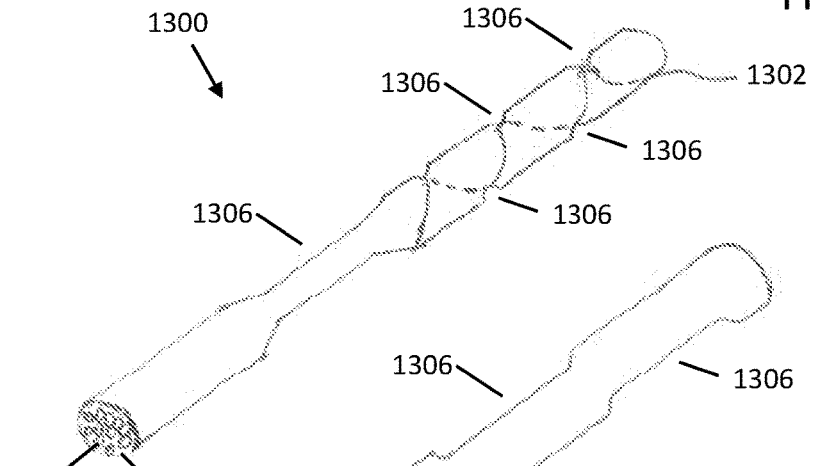
FIG. 13B
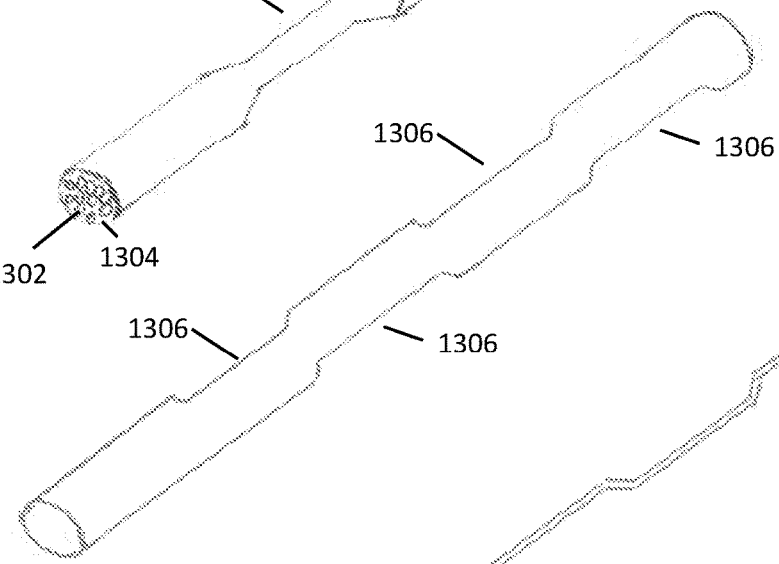
FIG. 13C
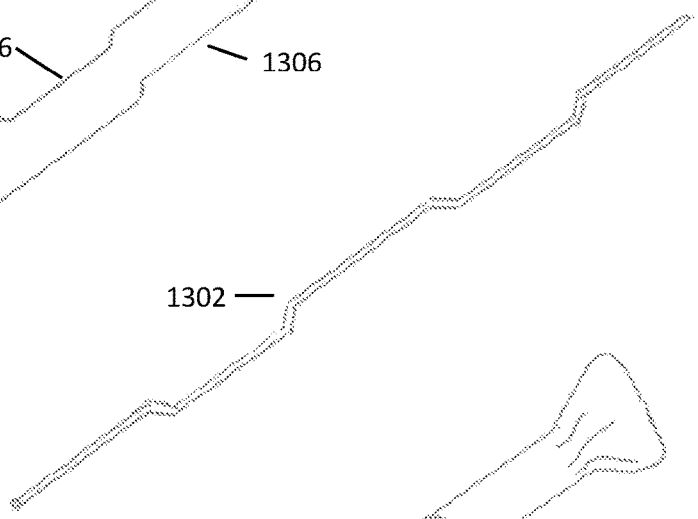
FIG. 13D
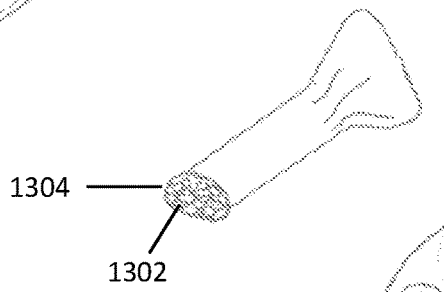
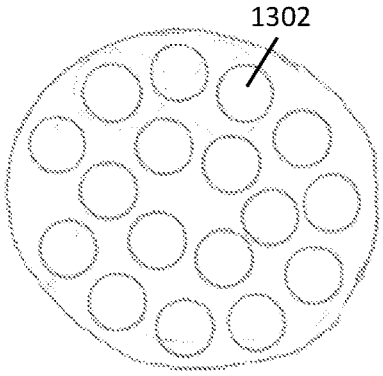
FIG. 13E

1302

1304
1302

BUILDING METHOD

The application claims priority to U.S. provisional application Ser. No. 62/895,837 filed Sep. 4, 2019, which is hereby incorporated by reference in its entirety.

FIELD

The present invention is directed to building methods, specifically to top down building methods using fixed flexible fabrics.

BACKGROUND

The need to provide ever more efficient methods of construction is an ongoing challenge. U.S. Pat. No. 5,566,521 discloses a form or mold that eliminates significant labor whereby an exoskeleton configuration of reinforced concrete can be efficiently fabricated. U.S. Pat. Nos. 8,104,233 and 8,627,612 disclose an even more efficient method for fabrication of load bearing exoskeleton structures comprising a flexible fabric having tensile load bearing capacity combined with a compressive load bearing material or fixative producing exoskeleton configured structures. U.S. Pat. No. 8,813,433 is an alternative method to economically and efficiently increase the amount of air relative to the amount of compressive and tensile load bearing materials in the core or intermediate layer of the exoskeleton configured assembly.

Traditionally, historically and pursuant to the prior art; the constructor has always fabricated buildings, or products, from the bottom up. In other words, the construction industry has always utilized the same sequence of steps to fabricate any structure, building or product from the lowest gravity dictated position. That sequence of steps or methodology has always started from the ground up by constructing a load bearing foundation upon which more load bearing elements would be constructed 'up' and or 'out' from. Thus, and as an example, in the construction industry the first step in the prior art was to construct the foundation on the ground. The second step up was to construct a load bearing structural skeleton or "support" elements on top of the foundation, be they permanent or temporary. The third step was to cover or sheet those elements progressing generally up and out or toward the 'outside' of the structure. Thus, the direction of construction of load bearing elements has always been substantially up and out, or substantially from the inside out.

Thus, historically for earth bound construction technologies, the lowest most 'internal' load bearing part is the ground. This lowest part, i.e. the lowest gravity dictated level, whether the earth or some pre-fabricated structure, is typically the foundation which will then support all of the other elements such as the walls, floors, roof, doors and windows of the building or structure as it is fabricated on top of and around this most internal part. The term 'ground' as used herein is defined as, and interchangeable with, the lowest gravity dictated level, if earthbound.

SUMMARY

Embodiments are drawn to methods of fabricating a structure including hanging a flexible fabric in a substantially vertical direction or orientation, shielding a portion of the flexible fabric and applying a fixative to an unshielded portion of the flexible fabric, thereby forming a fixed portion of the flexible fabric. A shielded portion of the flexible fabric is located in an upper portion of the flexible fabric and is configured to act as a bendable hinge allowing the fixed portion to be rotated.

BRIEF DESCRIPTION OF THE DRAWINGS

FIGS. 1A-1C are perspective drawings illustrating a method of making a structure according to an embodiment of the invention.

FIGS. 13A-13E are schematic diagrams illustrating basalt rebar according to various embodiments.

DETAILED DESCRIPTION

Figure 2A:
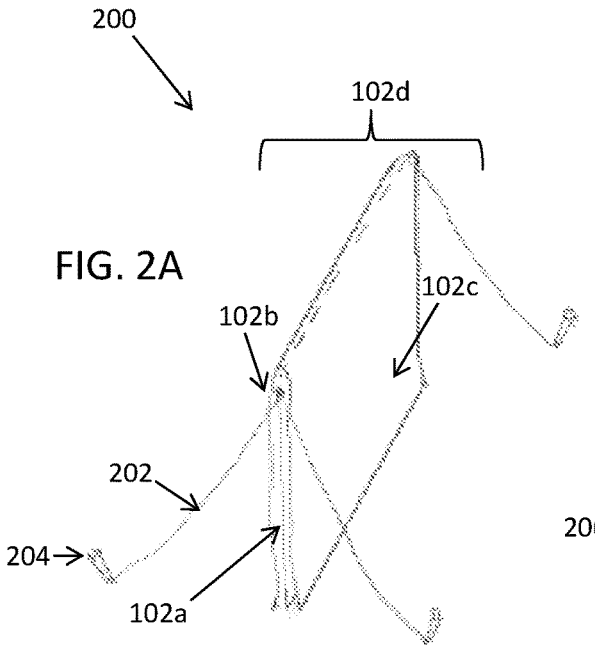
FIGS. 2A-2C are perspective drawings illustrating another embodiment of the method of making a structure.

As discussed in more detail below, the conventional sequence of steps in fabricating structures are reversed, such as fabricating houses. The exterior walls, interior walls, gable end walls, rake walls, and even the doors and windows are supported and fixed, which is to say fabricated, in situ, not from the foundation up, but from a first above, or overhead, structure such as an overhead roof or floor assembly. This first overhead structure will be identified herein as a "FOS." The FOS is fabricated from a flexible, drapable, net or fabric that is deployed in the desired position or shape and coated with a fixative that can be further described as a visco-elastomeric, or visco-elastomeric polymer, that hardens or solidifies the formerly flexible fabric into a permanent or fixed shape. The fixative should exhibit rapid gel times to maintain the shape in a fixed manner. The visco-elastomeric polymer fixative is also referred to as a cement or a binder.

Additionally, the visco-elastomeric polymer is the only true tensile element known because of the capacity to reach a state of equilibrium between the equal and opposing forces that are created when tensile load is applied. This 'force' that is equal to, and opposing the tensile load is a type of stored energy similar to the stored energy a spring exhibits. However, unlike a spring, the visco-elastomeric polymer does not fatigue or work harden.

In an alternative embodiment, the FOS can be a first overhead support comprised of such materials as described in U.S. Pat. Nos. 5,566,521, 8,104,233, 8,627,612 and 8,813,433 as they apply to the previously disclosed sequence of exo-skeleton configurations including folded plate configurations, hereby incorporated by reference in their entireties. A preferred embodiment of this invention comprises the first fixed net or FOS in combination with at least one more fixed net that may result in an exo-skeleton configuration of multiple layers such as two fixed nets separated by expanded fixative or at least one fixed layer being in a folded plate configuration combined with at least one planar fixed layer. Embodiments herein may utilize visco-elastomeric polymer materials to produce the cable, bar, pipe or other horizontal support to drape the net from in order to form various configurations disclosed herein. A further unique feature to this invention is the capacity of the net, with or without being fixed, to function as the lower membrane layer that bears tensile loads in both directions at the lower level of the folded plate bottom layer exo-skeleton assembly.

The flexible, drapable, net or fabric has modulus of elasticity or elastic modulus (E-values) ranging from very flexible rubber (1,450), to polyethylene (HDPE 116,000), to acrylic and nylon (approximately 450,000), to carbon fiber reinforced plastic (21,750,000). In a preferred embodiment utilizing basalt filaments, the average e-value for basalt is 12,900,000. Note, however, that materials such as structural steel with e-values such as 29,000,000 can be flexible if in a small enough cross-section.

The FOS can be a combination of multiple lightweight fixed single net layers or panels which are individually delineated as a FOSP, or first overhead structure panel. A single FOSP, or the combined entity of multiple FOSP layers, or panels, mechanically or covalently bonded one to another, preferably with a unique visco-elastomeric polymer, create the FOS that the exterior wall, interior wall, gable end wall, and rake wall nets, that are to be fixed in situ, can be hung from. Further, even the doors and windows can be hung from the FOS, or net which is suspended from the FOS; and fixed in situ. Thus, all of the parts of a structure such as walls and intermediate floors are not constructed from the foundation up, but are instead constructed from the top down. That is to say that the roof, as an example, may be the direct and permanent support from which the house is constructed as opposed to utilizing a permanent foundation as the support for walls that will ultimately support the roof to build the house, wherein the foundation provides the means of overcoming gravity as opposed to the FOS. Thus, according to this embodiment, the roof, or FOS, may be constructed before the foundation without reliance on any permanent gravity-oriented support. Further, this FOS, or individual FOSP, can be of any convenient dimension.

By eliminating auxiliary support materials, this invention significantly improves both material and labor efficiencies. As discussed above, the visco-elastomeric polymer can, in tension, provide a straight line between two points. As discussed below, embodiments of the invention eliminate up to 100% of the temporary and/or permanent auxiliary supports required by conventional methods used to fabricate assemblies of interior walls, exterior walls, gable end walls, rake walls, and to fix doors, windows and other amenities in situ. The term "auxiliary" is herein defined as any temporary or permanent support, brace, framework, formwork, mold, or form other than the ground. In various embodiments, any and/or all of the auxiliary supports, and compressive load bearing supports required by all conventional methods to support and fabricate a substantially horizontal assembly (e.g., an intermediate floor or roof) may be eliminated.

Embodiments described herein may provide for the elimination of: the framework, formwork and temporary or permanent support materials; the associated cost of procurement; the time and labor to handle and transport materials, both coming and going; the time and labor required to fabricate that framework or support; the time and labor required to dismantle the framework or supports if desired; plus the time, labor, equipment and infrastructure (roads, bridges, etc.) required to load, transport, off-load, and store those framework or support materials; and the financial resources necessary to continuously replace worn out framework and support materials; the necessity of men, or machines, required to fabricate structures from elevated platforms, such as ladders, man lifts, scaffolding, telescoping forklifts, boom trucks, cranes, etc.; the limitations created by the maximum height and reach capacities of those machines; the associated equipment and material lifts; and the limitations created by the maximum length and widths of materials that can be transported over roads.

Embodiments described herein may provide significant cost savings, reduction in time, labor and materials as compared to prior construction methodologies. This is true even if 100% elimination of the labor and the materials associated with temporary or permanent framework, formwork, or molds is limited to only, as an example, 50% of the steps in the fabrication process, or methodology steps, disclosed by any prior art.

The reason that construction methodologies have historically built from the inside out, or up and out, was simply that there was no other way to provide the required support and bracing with tensile and compressive load bearing capacity to support additional layers or structural assemblies to be added as the traditional construction process proceeded. In some loading situations, insufficiency of a first tensile and compressive load bearing single fixed net composite to bear the loads applied without additional layers (e.g., exoskeleton configuration, folded plate, or combinations thereof) was a significant problem. As disclosed in U.S. Pat. Nos. 8,104,233; 8,627,612 and 8,813,433, a tensile and compressive load bearing fixed fabric, or composite layer, uses additional sequential layers having different compositions such as 'foamed' or non-linear shapes, particularly as an intermediate layer to increase strength or load bearing capacity. As an example, increased loads encountered by long spans or extreme loading conditions can be accommodated by utilizing, a "folded plate" type configuration and/or a non-linear reinforcement in the core or intermediate area.

Embodiments disclosed herein provide a novel methodology and product in which a lightweight fixed single net layer section or FOSP of any convenient shape or size has the load bearing capacity to be utilized as a single fixed net, substantially horizontal, support defined as the 'first overhead structure', or FOS, without the necessity of multiple layers or net supports. Embodiments provide a sequential construction methodology whereby the load bearing capacity of a FOS does not by necessity have to be adequate to accommodate the ultimate or final loads generated by, as an example and without limitation, an entire roof structure or other large substantially horizontal surface area. Thus, the FOS is not required to have the ultimate or final load bearing capacity to span between permanent supports such as walls. As used herein, "substantially horizontal" is a deviation from vertical of from 5 degrees to 90 degrees. Also, in the context of this embodiment 'ultimate' load bearing capacity is defined as the live and dead loads, or total applied load, that is applied after the structure is completed and in use in its predetermined and specified function.

These 'large surface areas' might be in the range of 10-1,000 feet in width and 20-30,000 feet in length. Embodiments described herein allow for a light weight floor FOS or roof FOS, as an example, comprised of at least one tensile load bearing flexible net combined with a fixative to initially span between supporting walls as sequentially set forth herein. This may be done without regard to the distance between the supports, and without increase in depth of beam as taught in the prior art when longer spans are encountered. Wherein 'fixative' can also be defined as any material that achieves adequate compressive and tensile load bearing strength to bear the load next applied. To bear a load means that both the tensile and compressive capacities (measured in psi) are equal to or greater than the load (which yields tensile or compressive reactions again typically measured in psi) and thus having the capacity or ability to "support"/ "hold up" the total applied load. Thus, the capacity to bear a load is the ability to counteract the forces of the load applied while sustaining and maintaining the shape, orientation, or any other physical characteristic without substantial change due to the load applied.

Thus, a FOS, or a single FOSP, can function as the sole support for the fabrication of supports functioning as conventional support structures or components, weighing from 500 pounds to 1,500 tons or more, such as those found in highway bridge construction. Example structures includes structural steel I-beams and other shapes, steel or reinforced concrete bridge supports or columns, floor or roof support columns, decks, walls, dams, retaining walls, etc.

In embodiments related to infrastructure repair, such as bridge repair, the existing overhead assemblies can be utilized to hang or support nets to be fixed in situ without molds or auxiliary formwork, or reliance on initial load bearing support from the ground level. Further, additional reinforcement such as steel or basalt reinforcing bar, or more nets whether fixed or not, can be hung from either the first fixed net, before or after fixing, or the existing overhead structure, or both.

Alternatively, where there is no existing FOS, a substantially horizontal support element may be provided by the visco-elastomeric polymer whether in the form of a strand, bundle of strands, or even a net because as already discussed, the visco-elastomeric material is a true tensile element in that it has the capacity to span from one point to another without deflection. Thus, this eliminates supporting materials that are required by all other technologies and previous patents.

Definitions: "applied fixative", "fixed", "hardened", "coated", "gelled", herein stated are defined as a process in which an at least a flowable compressive load bearing material, or 'fixative', coats and may penetrate the tensile load bearing fabric/net, rebar, encompass bulk filler/aggregate, or other materials and take a set, i.e. hardens.

In a preferred embodiment, using a visco-elastomeric fixative, the initial gel times to "freeze", "fix" or otherwise "harden" any FOS or part/product is as short as one (1) minute or up to eight (8) hours. Rapid gel times is a preferred attribute or characteristic in this embodiment. Rapid and controlled gel and cure times are also preferred for net, rebar, and manipulated basalt, or other, filament fabrication due to economies in production.

The fibers or filaments comprising the fabric, rebar, or other reinforcement are bonded together with a "binder", as an example a visco-elastomeric polymer. Examples of fibers or filaments are basalt fiber, carbon fiber, steel, fiberglass, graphene and other load bearing materials. A binder can also be utilized to bond and solidify or fix aggregates together to produce the compressive load bearing element or fixative. Examples of aggregates include soils, ashes, municipal waste stream materials, mine tailings, mill tailings, traditional aggregates such as sand and gravel, and generally any material whether organic or inorganic. Thus, the fixative may comprise the same binder as the sizing, glue or matrix utilized to bond or glue the fibers or filaments together. The fixative keeps those fibers or filaments comprising the net, fabric, rebar or other construction material in discipline. Alternately "fixed" can mean fabricated whether the part is completed or not.

In a preferred embodiment, the visco-elastomeric binder provides atomic or nano characteristics of a monolithic covalent bond and there are no cold joints. A cold joint is defined as a deficiency in which once the cementitious material sets up or cures, another contiguous application of the cementitious material does not bond covalently, but instead has defects, such as weaker ionic bonding. In an embodiment, the visco-elastomeric binder forms covalent bonds. A covalent bond is a chemical bond that involves the sharing of electron pairs between atoms. A covalent bond is not subject to delamination without high heat (smelting temps in excess of 2500 degrees C.) and/or kinetic energy loads greater than the modulus of elasticity of the fixative, binder, or cement.

In a preferred embodiment "gel", "gelling", or "gel time" is defined as the time the fixative or cement binder takes to obtain an initial, but not ultimate, set or level of hardness and structural load bearing capacity wherein the shape, size, or other physical characteristic does not change due to the loading applied. The gel time can be controlled between one (1) minute to eight (8) hours. Thus the 'pot life' or working time for visco-elastomeric mixes is the same; ranging from one (1) minute to eight (8) hours. The gel, or working time, can be accurately controlled within one (1) minute increments. The time to ultimate strength, or full cure, ranges from forty eight (48) hours to thirty (30) days.

The compressive load bearing capacities of the visco-elastomeric polymer cement/binder, with or without any chosen aggregate(s) i.e. concrete, ranges from 10 psi to 10,000 psi, from 10,000 psi to 30,000 psi. The tensile load bearing capacities of combined visco-elastomeric polymer cement/binder, with or without chosen aggregate(s) i.e. concrete, range from 10 psi to 10,000 psi, from 10,000 psi to 30,000 psi. Because the modulus of elasticity (or elastic modulus) is equal to the valence electron energy exchange energy required to allow or force the change of state of the material. Therefore, in tensile load, the strength of the material has the ability to be equal to the force required for the material to lose its properties or it's state of energy. Thus, the force stays in equilibrium allowing no deformation to take place, that is producing equal and opposite opposing forces.

For this reason, the visco-elastomeric polymer, as a stand alone material, is effectively the only true tensile load bearing element. Thus, all structures, or components of structures, and products may have all of these unique features. The covalent bonds are not subject to delamination or separation without high heat (smelting temps in excess of 2500 degrees C.) and/or kinetic energy loads greater than the modulus of elasticity.

If desired, this visco-elastomeric polymer based 'concrete' or mixed base material composition can mimic the properties or characteristics of the base materials being covalently bonded together. As an example, the properties of steel, or other materials, having the capability of variable compositions of coefficients of expansion, can be obtained. Versatile mix designs combining visco-elastomeric polymer cement and filler materials i.e. aggregates, emulate or mimic the same capacities to be machined analogous to steel, or drilled, or tapped, molded or sawn like wood or any other embodiment desired.

In the case of mix designs analogous to traditional Portland based concrete in which the visco-elastomeric polymer binder replaces Portland cement, the final compressive and tensile load bearing strengths of this new 'concrete' is easily and accurately predetermined because the visco-elastomeric binder can be combined with any known aggregate without deleterious effects upon the strength of the covalent bonds. As a cementitious material or concrete product, the visco-elastomeric polymer binder/cement is unique in that it produces concrete, or composite materials, that have higher tensile load bearing capacities than any other known concrete.

In an embodiment, the visco-elastomeric polymer cement/binder is derived from organic substances but can be combined with inorganics. The visco-elastomeric polymer used in this embodiment can be extracted from plant based cellulose, or cellular materials, or any other leachable titrated or synthesized material forming binders. When fabricating disclosed structural elements this, embodiment includes methods such as pultrusion, pushtrusion, extrusion or vacuum molding or any other method of forming utilizing pressure, whether it be positive or negative pressure, or methods utilizing gravity. Further, the visco-elastomeric polymer is a superior 'sizing' or bonding material in the production/fabrication of basalt based, or composite, products such as basalt fibers and any other products. Finally, the visco-elastomeric polymer binder can be used as an additive to conventional sizing materials to provide improved characteristics to the final product or composite.

In the case of basalt filament manipulation in a fabrication process utilizing any of the foregoing methods, such as pultrusion, pushtrusion, extrusion or vacuum molding or any other forming method, the filaments can be manipulated at ambient air temperature. This manipulation is permanent due to the covalent bonding of the visco-elastomeric fixative or cement which constrains or holds the filaments, of any length or size, in the desired manipulated shape such as bent, kinked, looped or other desired shape. Such products and composites utilizing the visco-elastomeric polymer have the additional feature of near zero resonance, as measured in hertz, thus these products/composites typically do not fatigue or work harden (crack).

In an embodiment, the binder may be a stand-alone element, or component, that has the structural load bearing capacity to bear tensile loads, or compressive loads, or both. "Net" or "fabric" is herein defined as a flexible sheet or fabric material whether porous or not. Therefore, as defined in this disclosure, an easily bent or flexible net might be manipulated, bent, or deformed by manual force and without the aid of mechanical force. "Overcoat" or "overcoating" is defined as a flowable material that is applied to a flexible fabric to decrease, or minimize, the flexibility but not necessarily fix or totally eliminate flexibility of the fabric.

In an embodiment, the binder, fixative or cement is a visco-elastomeric polymer. The visco-elastomeric polymer may be thermally non-conductive to 2200 degrees F. (1204.4 degrees C.) with a near zero resonance. In an embodiment, all products or materials using a visco-elastomeric are impermeable. Further, these materials are not subject to degradation or effected by salts, acids or solvent based reagents or chemicals or compounds possessing attributes of either thermal decomposition or mechanical/physical decomposition.

Preferably, the visco-elastomeric materials exhibit a zero coefficient of expansion relative to temperatures up to 2200 degrees F. and are thermally non-conductive to 2200 degrees F. (1204.4 degrees C.) with a near zero resonance. Depending on tensile or compressive load bearing materials being bound together, the resultant composite materials are excellent insulators exhibiting extremely high R-values, such as greater than 20, such as greater than 80 per inch. The visco-elastomeric binder has working temperatures ranging from cryogenic (minus 459.675 F) to 2200 F, or from minus 273.15 C to 1,204 C. This binder utilizes a covalent bond eliminating cold joints and provides the capacity to bond and solidify almost any material. The visco-elastomeric polymer allows mix designs of materials, such as lipids and water, which do not traditionally or historically mix or combine. As an example, hydrophilic and hydrophobic materials can be mixed together to produce any material such as cement, concrete, net, rebar. Materials bound together, solidified or coated with this binder do not support mold, mildew, barnacle growth or pathogens. That is, the visco-elastomeric polymer does not allow the propagation of life for any cellular material. Structures subjected to extremely wet conditions, or even immersed under water do not support mold, mildew, barnacle growth or any freshwater/saltwater fouling.

Because the visco-elastomeric binder is thermally non-conductive to 2200 degrees f. (1204.4 c) with a near zero resonance this binder provides materials that are fireproof. Therefore, because the binder is thermally non-conductive all materials, or composite products, exhibit extremely high R-values approaching the level of being thermally non-conductive.

In an embodiment, the melting temperature of the visco-elastomeric cement is about 1204.4 C or 2200 F. The visco-elastomeric binder can eliminate toxicity, or permanently sequester toxins, in materials bonded together with the visco-elastomeric polymer. The visco-elastomeric cement/binder is derived from organic substances but can be combined with inorganics.

In an embodiment, the visco-elastomeric binder is 100% non-toxic. Preferably, the gelled or set visco-elastomeric material is impermeable to any liquids (any liquids encompassing full spectrum of pH scale ranging from 2.5 to 14). Depending on the tensile element bound glued together i.e. kept in discipline, this composite comprising binder and tensile element can yield tensile strengths such as 100 psi to 500 psi, such as 500 psi to 60,000 psi. Depending on compressive materials to be bound and glued together, or kept in discipline, this composite binder can yield compressive strengths of 100 psi to 500 psi, such as 500 psi to 60,000 psi. This binder can also provide specified composite materials that exhibit elastic characteristics whereby deflection of a structure can occur without degradation to the structure and further, the structure can return to the original shape without degradation. In an embodiment, the binder provides 'self-healing' characteristics wherein a scratched, cut or dismembered piece of material may repair that scratch, or cut, or become whole again without the necessity of any other added energy or material.

As understood by those skilled in the art, there are mathematical protocols or calculations that dictate an increase in depth of member, while at the same time limiting or minimizing the self-weight of the assembly, to accommodate longer spans and heavier loads. This is the reason the prior art included disclosures addressing this need by utilizing, for example, a folded plate configuration or a non-linear bar, which could be combined with a planar fixed net, or top and bottom planar fixed nets or skins.

Thus, the prior art did have the capacity to support extreme weight or load, even in long spans, when additional layers were added to that particular composite assembly of layers. However, the inventor has discovered that it is more efficient to not add additional layers, or different shapes of layers, to the first fixed net layer until, and only if the sequence of construction set forth herein requires additional layers or shapes. Instead, the inventor has found that a substantially horizontal first fixed net layer, such as a single fixed net layer floor or roof panel can have the load bearing capacity to support, or hang, vertical tensile load bearing nets while they are being fixed. These novel construction methods can utilize traditional tensile and compressive load bearing materials. However, in a preferred embodiment, utilizing a visco-elastomeric binder to produce the tensile and compressive load bearing materials, the teachings herein provide for increases in structural efficiencies such as 30-40% greater, such as 40-70% greater, than traditional cements, binders, sizing materials, etc. of any prior art. This sequence of first constructing a floor or roof comprising only a single fixed net layer, as opposed to the previously required exoskeleton sandwich or folded plate assembly, provides the load bearing capacity to hang an entirely different building part or component under the first part. This method contrasts with the prior art which specifies that additional layers be added to the first fixed net layer to accommodate the span and loads, e.g. from one exterior wall to the other, as is the traditional practice in the prior art. Alternately, the prior art has accommodated these spans and loads by utilizing a first layer that has sufficient depth of member. However, as is apparent to those skilled; by increasing the depth of the first layer to accommodate span and final loading, one loses some of the advantages of this embodiment, such as minimalization of materials, thus labor, weight, cost, time, etc., pertaining to the single lightweight fixed fabric layer which may or may not ultimately be configured into an exoskeleton assembly. Those skilled will also understand that by hanging a net, and then fixing that net, the fabrication of a substantially flat planar fixed net can be achieved.

Thus, embodiments of the invention are advantageous because of the elimination of costly time, labor and materials necessary to provide second or third layers that are of a different density (foamed) or shape, or substantially non-linear i.e. 'folded plate' shape or configuration, or thick layers, to span between walls or supports before any nets can be supported, or hung, and fixed. Thus, a thickened layer might be a layer thicker than one quarter inch when applied to smaller loads or more than one inch in the case of long spans with increased loads.

In an embodiment, at least one FOSP is constructed and ultimately entire floors, or roofs from a lighter weight composite layer comprising a first layer of flexible tensile load bearing net that is fixed with a compressive load bearing material, such as a visco-elastomeric polymer, or any cementitious material or any other material that takes a 'set' or hardens. Wherein light or lighter weight can be defined as the weight of a single layer flexible net that has a total fixative thickness of no more than 3 inches, such as no more than 1 inch, such as no more than ½ inch. One or more FOSP can be referred to as FOS. Cementitious materials and fixative are defined as flowable or plastic materials that take a 'set', or harden after being applied to the tensile load bearing net or fabric. This material may also be defined as "a binder" and can have covalent bonding characteristics which mechanically and monolithically attach one part to another in the fabrication process. A characteristic of the covalent bonding capacity of the binder is the elimination of cold joints. Cold joints can be defined as the prior art deficiencies wherein once the cementitious material sets up or cures, another contiguous application of the cementitious material does not bond covalently but instead has the inherent weakness of ionic bonding, as an example.

Suitable fixatives include, but are not limited to visco-elastomeric polymers, such as those disclosed in U.S. Pat. No. 8,475,586, hereby incorporated by reference, Zero Thermal™, ElastoFoam™ Crete and concrete. The flowable or plastic materials may be applied by spraying, brushing, troweling, or other means. Other suitable materials include ElastoFoam™ Crete, concrete, polymer based binders, adhesives, fixatives, mediums, matrices and cements, as well as Portland cements, geo-polymer cements, urea formaldehyde, epoxies, resins, cements, glues, adhesives, magnesium oxide cements, etc. In a preferred embodiment, a fixative, or binder is provided that can yield 3,000-6,000 psi compressive strength; and 1,000-2,000 psi tensile strength within 1-2 minutes, or 2-5 minutes as examples. Further this preferred embodiment can provide this high strength and fast cure time with 20-40%, or 40-90% air entrainment or expansion (foamed with air). Further, preferred binders, when mixed with a selected raw material such as dirt, waste stream materials, ash, as examples, can covalently solidify these and almost any material, including oil (lipids), into a load bearing fixative above described. The flowable or plastic materials may be applied by spraying, brushing, troweling, or otherwise coating the selected material, with or without penetration, imbedding, and or penetration and methods of providing for a composite of load bearing materials of the selected materials. Alternately, any net or fabric (load bearing or not), when combined with the binder, can provide the necessary load bearing capacity to be utilized as a stand-alone end finished product, or manufactured product. Or, as an independent building component without additional layers even when the ultimate loading of the entire floor or roof is greater than the load bearing capacity of that single FOSP or FOS. In this invention "ultimate loading" is understood as the load that will be carried, resisted, or borne, by the fixed fabric after all load bearing parts of the structure are in place, i.e. after completion and in the designed use.

In an embodiment, the initial load bearing capacity of a FOSP, or FOS of a substantially horizontal building component (floor, flat or conical roof) spanning between supports or cantilevered from a support can be less than the ultimate or final load bearing capacity, required to span between, or from, those same supports. Yet, the FOSP, or FOS, can accommodate such future 'overloading' without failure because walls (as examples) are hung and fixed sequentially and under a FOSP, while the ultimate or final dimension of that FOS is achieved incrementally. This sequence of fabrication can eliminate, or temporarily mitigate, the increased load bearing capacity created by, as an example, long spans between supports e.g. exterior walls during the construction sequence as taught in the prior art.

Further, reducing the substantially horizontal load bearing surface to smaller sequential sections, or FOSP's, can eliminate up to 100% of the temporary or permanent compressive load bearing supports, framework, formwork, or molds traditionally required under larger horizontal surfaces such as intermediate floors, decks, and roofs having dimensions of, for example, 10 feet by 10 feet, such as 16 feet by 30 feet or more.

In another embodiment, a light weight FOS is fabricated, which comprises a first layer of tensile load bearing net that is treated, or fixed, with a first compressive load bearing fixative that does not require any additional structural load bearing layers, or non-linear reinforcement layers, to function as a FOS regardless of the ultimate span or loading. Because of the unique features of this methodology, a FOSP might weigh only ½ psf-6 psf yet ultimately function as a large floor or roof area that would, by ultimate load bearing necessity, have dictated that the same size of traditional floor or roof assembly weigh from 10 to 500 psf depending on span to accommodate depth of beam i.e. load bearing capacity required, where psf=pound per square foot. In another example, the prior art may require a depth of member between, as an example, 4-12 inches to accommodate span or loading; while this invention would permit the FOS, in the same application, to function with a depth of only ¼-2 inches. This feature is amplified by the utilization of a preferred fixative, such as a visco-elastomeric polymer, having compressive load bearing capacities between 10 and 20,000 psi or more. It is further a feature of the visco-elastomeric polymer that this compressive load bearing capacity can be attained within minutes of the fixative being applied, 1 to 3 minutes, or 4-5 minutes or longer if desired by extending the working time or pot life of up to eight hours. As already noted, the fast product gel time, and or set time, is important to maximize the efficacies of the process.

Further, the importance of both compressive and tensile load bearing capacity per pound of compressive or tensile load bearing material is a factor in determining, or calculating, the efficiencies of various embodiments disclosed herein. In the preferred product embodiment, both tensile and compressive load bearing capacities can approach 8,000 psi or 25,000 psi. The 'dead weight', or 'self weight' of the structural component, whether FOSP, FOS, wall, or any other load bearing structure is minimized producing improvements in structural load bearing efficiencies of more than 20%, of more than 80%.

An embodiment of the method 100 is illustrated in FIGS. 1A-1C. In this embodiment, a light weight first overhead structure panel 102*b* or FOSP is fabricated that comprises a first layer of tensile load bearing net that is treated, or fixed, with a compressive load bearing fixative having sufficient strength, or load bearing capacity, without the unnecessary additional weight entailed by additional layers, or of non-linear layers, to be used when the first fixed above component structure is to be rotated R1 into position of final use. As illustrated in FIG. 1A, the first overhead structure panel 102*b* is formed by fixing a first layer of tensile load bearing net which is hanging vertically from a first fixed layer 102*a*. In an embodiment, the first layer of tensile load bearing net 102*a* may be hung between two support posts 106 and fixed. As previously noted, the preferred embodiment of the net and/or fixative product is a true tensile element and thus will not sag. Because the first net 102*a* bears tensile loads applied, no other support between the posts is necessary, i.e. the flexible net is self-supporting whether fixed or not. Thus, a feature of this invention is the elimination of any horizontal support to suspend the first fabric from while being fixed in a vertical orientation. Fixing the fabric or net while in the vertical orientation takes advantage of gravity, which is effectively utilized as the forming or shaping mechanism, or technique, to achieve a substantially perfect flat/planar panel. That said, the only supports required are vertical supports such as posts 106. Alternately, tensile load bearing net 102*a* was fixed while being suspended from any appropriate element that is attached to, and between, the poles. However, as discussed above, the first layer of tensile load bearing net 102*a* may alternatively be fixed while lying horizontally on the ground or some other surface which eliminates both horizontal and vertical support requirements. Alternately, tensile load bearing net 102*a* may be rotated after fixing and thus function as first overhead structure panel 102*b* after rotation. As further illustrated in FIG. 1A and discussed in more detail below, a portion 104 of the first layer of tensile load bearing net of the first overhead structure panel 102*b* may be masked, or shielded, and thereby not be fixed when the fixative is applied. The unfixed portion 104 is still flexible and may be used as a hinge, or point of rotation, allowing the fixed first layer of tensile load bearing net to rotate R1 into position to form the first overhead structure panel 102*b*. FIG. 1B is a close up of FIG. 1A and illustrating the hinge, i.e. the unfixed portion 104, between the supporting first layer of tensile load bearing net 102*a* and the first overhead structure panel 102*b*.

FIG. 1C illustrates an alternative aspect of this embodiment illustrated in FIGS. 1A and 1 B. In this aspect, an additional piece of flexible fabric 108 is affixed to the first layer of fixed tensile load bearing net 102*a* and the first overhead structure panel 102*b*. The additional piece of flexible fabric 108 provides additional support for the first layer of tensile load bearing net 102*a* if the first layer of tensile load bearing net 102*a* is rotated up, rotation R1, to become part of a ceiling upper floor, or deck as illustrated in FIG. 1 and FIG. 2. A layer of load bearing material can be applied to one or both sides. Reinforcement can also be applied to any FOSP surfaces, at any desirable location, whether the FOSP panels are rotated or not.

In another embodiment, a light weight FOSP is fabricated which comprises a first flat planar layer of tensile load bearing net that is treated, or fixed, with a first compressive load bearing fixative before being rotated or adjusted into final position.

Another embodiment includes a method of constructing a light weight FOSP comprising a first flat planar layer of fixed tensile load bearing net that is fixed with a disproportionate amount fixing material on the side of the net that might be subjected to predominately compressive loads. A disproportionate amount is defined as an unequal amount. That is, one side of the fixed tensile load bearing net comprises more fixing material than the opposing side. Alternately, within the preferred product embodiment, the fixative also has tensile load bearing capacity approaching 20,000 psi, approaching 29,000 psi. Thus, the same teaching can apply to a disproportionate amount or thickness of proprietary fixative on the desired side.

As an example, the net may have only ⅛ inch of compressive load bearing binder or fixative applied to one side of the net, while the opposing side may have, as an example, ¼ inch to ⅝ inch of compressive load bearing material applied. In this embodiment, the fixative may be applied from one side only, whether applied manually or via pressure through a hose (e.g. shotcrete or gunnite). The natural penetration of the fixative into and through the net can provide a thin layer of fixative on the opposite side. Depending on the grid size of the net, such as ½ cm to 4 cm, and mix design of the fixative, the penetration and resultant amount of material on the opposite side can be controlled. When more fixative is allowed to penetrate the net, it may be desirable to screed or trowel float the fixative to a smooth surface which can then function as a finished surface. Further, the side from which the fixative is being applied can similarly be troweled and function as a finished surface, thus providing a finished product produced in situ. Alternately, the fixative can have covalent bonding characteristics that may eliminate any need for penetration. Further, this unique fixative characteristic provides for nets or fabrics that are not porous, i.e. do not have potential for openings or spaces between the fibers comprising the net. That is, the tensile load bearing material may be a non-porous material. Thus, in the context of this invention, a net or fabric are defined as any flexible sheet good or product whether it is porous or not.

As used herein, the term 'in situ' describes the characteristic of a product being fabricated while attached to, or having at least some communication with, the place of final utilization but not necessarily the orientation of final utilization, thus allowing for rotation or minor adjustment, but not re-location relative to the positioning of the final combined panel assembly, e.g. such as an entire or completed roof assembly or FOS.

U.S. Pat. Nos. 8,104,233; 8,627,612; and 8,813,433 disclose substantially horizontal layers, such as floor and roof, as being fixed in place of final use and orientation. However, even with a minimum amount of fixative applied, the net tends to sag, or distort, under load of the fixative unless the tensile load on the net is adequate to overcome the deadload of the fixative. Alternately, this might be overcome by decreasing the distance between supports. However, as is understood by those skilled in the art, decreasing the distance between supports means increasing the number of supports to minimize the problem. Further, the only way the prior art could completely eliminate this problem is to have little or no space between supports. This is equivalent to providing a solid mold or form surface. Thus, as taught according to embodiments of this invention the in-situ product can easily and efficiently eliminate this problem by using gravity to dictate the flat or planar shape. However, as disclosed above the preferred embodiment of the product utilizes the preferred visco-elastomeric fixative combined with a net comprising visco-elastomeric polymer that is a true tensile element thus does not sag. It is important to note that the unique features of this product are inseparable from the method because the method features are a result, or product, of the preferred embodiment.

Thus, in a vertical, or gravity dictated embodiment, all of the distortion is eliminated without increasing the number of supports required. Further, as discussed above, the temporary and/or permanent supports and forms may be totally eliminated.

A further embodiment relates to an improved product. In this embodiment, the first fixed net layer may have the additional attributes and improved load bearing capacity of a thickened compressive load bearing fixative layer on the side of the product that will be subjected to compressive loading without requiring more support to avoid distortion under load of increased flowable fixative. Prior art net construction specified that the net be in the final desired shape and typically in the final position and orientation when being fixed in situ. The prior art defined "in situ" as "in the place or position of final use". This substantially horizontal orientation of the net (floor or roof as examples) precluded the builder from applying a thickened layer of compressive load bearing material on the compressive load bearing side because that would result in significant increased loading from the flowable compressive load bearing material. This increased loading resulting from a thickened layer of ⅛ inch to 6 inches causes the floor or roof net to suffer increased deformation or distortion from planar under the increased load.

As is well understood in the different construction arts and disciplines, materials and surfaces are not exact or perfect and are subject to what is commonly referred to as "acceptable tolerances or practice." However, as is also well understood, more horizontal supports or increased framework is typically required to overcome 'sagging' or distortion of the net in the prior art. But, more horizontal supports or increased framework is inefficient. Thus, an embodiment provides an orientation of the net that allows the constructor to easily and efficiently apply the compressive load bearing fixative without any of the product distortion typical in the prior art. Further, this method of construction eliminates the requirement of increased support or framework to accommodate the increased load bearing requirements of thicker fixative applications. This embodiment further eliminates the need for multiple horizontal supports, or a mold, to minimize the distortion or deformation of the first net layer as it is being fixed to an acceptable degree of flatness that is within case specific tolerances in the construction industry or more simply stated: 'substantially planar or flat'.

Fixing a net in the vertical orientation before rotating it into the substantially horizontal orientation can eliminate 100% of the distortion or sagging demonstrated by the prior art. Another advantage of this lighter weight in situ product is that it can be one of many finished products, in combination or assembly, to construct a building or other structure.

In another embodiment, the first fixed tensile load bearing net layer has the capacity to serve as a support, or FOS, that can hold or support additional tensile load bearing nets, doors, windows, and other such construction amenities, in situ as defined as being fixed proximal to final use, but not necessarily the orientation of final use. As an additional advantage, this first lighter weight fixed single net layer can also be the finished product or serve as a mold or support for additional layers as taught. It is notable that any teaching, of any component structure whether a single flat fixed net layer, a folded plate or any other endo or exoskeleton configuration is applicable to all other components or teachings and entire structures or products. In addition, as those skilled understand; this product feature, or versatility, is made possible by the in-situ method of fabrication. Therefore, the product is not independent of the method because one derives from, or is dependent upon, the other.

Thus, the sequence of hanging or supporting additional tensile load bearing nets under an existing FOS support, and then fixing said nets to provide structural load bearing capacity under or in support of that same FOS, decreases the required load bearing capacities of the FOS by virtue of decreasing the span of the FOS and/or providing additional permanent or temporary support for that FOS in specified places where additional loading or point loads are to land. In other words, placing or hinging the support under or in the proximity of a load to be applied later in the construction process, i.e. dead loads and/or future live or dead loads.

An embodiment includes a method in which the first fixed net layer with desired light weight characteristics can be configured in a single simplified planar first fixed net configuration yet still provide the load bearing capacity of an exoskeleton assembly, or elements of increased depth of member, or an assembly requiring non-linear shapes for reinforcement as previously required by prior art methods in the case of long spans or extreme loading. As an example, for long spans, the prior art required construction of a FOS that would span from final support wall to final support wall which would require significant depth of member, or an exo-skeleton assembly, or a folded plate configuration as examples. An example of a prior art wood framed analogy of a FOS would require a depth of beam of at least 10 inches to span 14-16 feet depending on load conditions. Then, and only then, could such a prior art dimensional lumber FOS have been constructed with adequate load bearing capacity within the teachings of the prior art. However pursuant to this invention, as set forth herein, the FOS might have a depth of beam less than one inch and accommodate the same final or ultimate loads after completion of the construction process; as did the lumber example.

Thus, it is desirable to have an improved first fixed net layer panel having lighter weight and minimal depth characteristics for a novel construction sequence in which the roof, or FOS, provides the means whereby the interior and exterior walls, gable end walls and even fixtures and amenities such as doors and windows for buildings or structures of any size can be efficiently constructed from the top down, or outside in without the need for temporary or permanent supports, or depth of member capacities that would dictate an exo-skeleton or increased depth of member configurations as taught by the prior art.

Constructing the roof, or upper floor, first has never before been considered because of the numerous constraints imposed by the prior art. Such constraints include 3 times the weight, or more, per square foot to accommodate the span and loads imposed by all prior construction methodologies and products. Embodiments of this invention provide a lighter weight fixed net product that allows embodiments of the method to function more efficiently than the prior art by greatly reducing or totally eliminating the load bearing support materials, and the associated labor, required.

Further, the lighter weight panel makes construction of any size building possible utilizing minimal manpower without the need of any heavy lifting construction machinery or equipment because the building component sections to be placed in position of final use weigh half as much due to them being rotated into orientation of final use.

The advantages of first fabricating the roof, OR FOS, significantly reduces the cost and thereby increasing the efficiency of this construction methodology as opposed to those disclosed in the prior art by eliminating all ancillary or auxiliary horizontal supports, and/or auxiliary substantially vertical supports and framework for nets that can now be fixed in a substantially vertical orientation and then if desired, for final utilization, be rotated or adjusted into their final or permanent position of use.

As disclosed in the prior art, floor and/or roof fabrication (as an example) is predicated upon the prior presence of the required walls on which the multiple temporary supports would be placed, e.g. the multiple horizontal supports to fabricate a folded plate. Or alternately, multiple temporary supports would first have to be constructed to take the place of the walls to support the predominately horizontal tensile net, or to support those next temporary supports that would then support the net to be fixed for the fabrication of the floor or roof assembly.

As discussed above, the horizontal supports for a horizontal flexible net that is to be coated with fixative must be spaced within 1 or 2 feet of each other on center, or less depending on the thickness of fixative applied and the amount of tolerance for sagging/distortion that is acceptable. However, it is impossible to fabricate a perfectly flat fixed flexible net in horizontal orientation outside of this invention without any distortion due to weight of fixative unless the supports are so close as to effectively yield a solid mold or form surface. However, embodiments described herein can provide a flat horizontal surface without sagging due to weight of fixative, by first applying the fixative to the flexible tensile load bearing net while the net is in a substantially vertical orientation and then rotating it into a substantially horizontal orientation.

In an embodiment, all of the temporary and permanent framework, supports and the associated labor and material costs as required in the prior art are eliminated. Also, the necessity of the use of forms or molds as taught by other prior art is eliminated. In an embodiment, this is accomplished by having only one supporting building component that has the capacity to support in final position and orientation all of the fabrics utilized for interior walls, exterior walls, gable end walls, door and window support, and other amenities. This is accomplished without any auxiliary supports and braces while these components are fixed in situ. The individual components may be fixed with an application of binder or cementitious material, producing a composite or assembly while in the gravity dictated position. Then the individual composite or assembly may be rotated into orientation and position of final use if needed.

In an embodiment, all previously required supports may be eliminated by replacing them with one roof (as an example) product or FOS. All the tensile load bearing nets may be hung from this one roof panel or assembly, without any auxiliary "supports" as specified in the prior art, while this fabric is being coated with applied hardener/fixative.

Figure 2B:
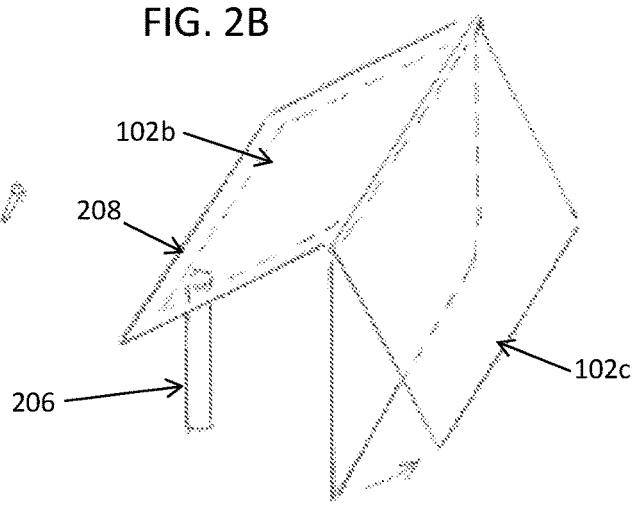
Figure 2C:
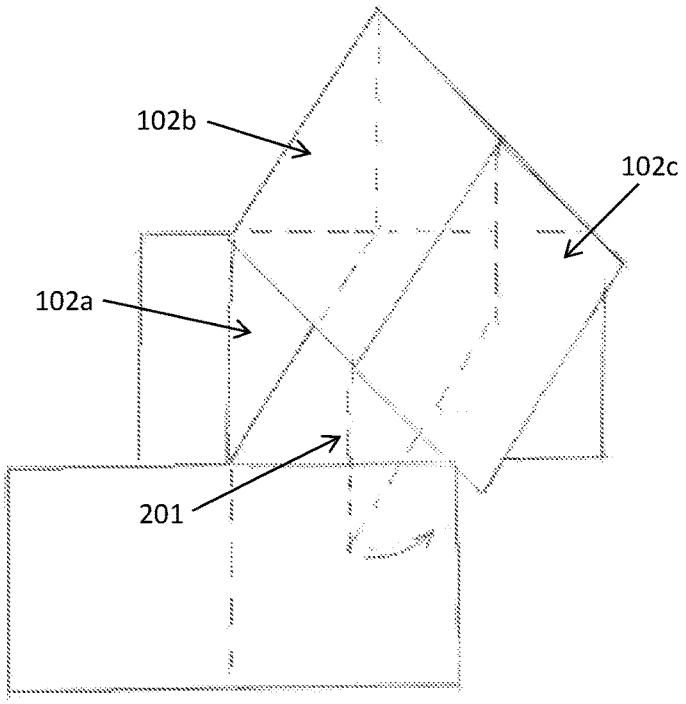

An embodiment of the method is illustrated in FIGS. 2A-2C. In this embodiment for roof or floor panel fabrication, the method includes suspending a flexible net 102*b* from a single horizontal support 102*a* while the net is fixed to form a first fixed layer 102*b*. As disclosed in the prior art this particular phase would require at least three supports. In this embodiment, the net or nets may be hung from a fixed planar net panel 102*a* of, for example, 8 ft.×8 ft. in dimension. Though other dimensions, greater or smaller than 8 ft. may be used. This fixed planar net panel 102*a* may be fixed while positioned in a substantially horizontal orientation on the ground or another gravity dictated and somewhat level surface as discussed in regards to FIGS. 1A-1C above. The light weight fixed net can then easily be tilted up, or rotated, into a vertical, or substantially vertical position and held in that position with tensile load bearing supports such as a rope or cable 202, held in position by any desirably method such as pegs 204. This is done without any compressive load bearing support elements.

A second net 102*b* may be hung from the single horizontal support formed by the top of the first fixed net 102*a*, or any part of the first fixed net 102*a*, and rotated into a vertical position. This second net can then be fixed in the gravity dictated orientation without any compressive load bearing braces, supports, or framework. Then a third net 102*c* can be hung or supported by the top edge of the first fixed net 102*a* and fixed in the gravity dictated orientation. The third net 102*c* can be on either side of the first fixed net 102*a* which demonstrates that multiple nets can be fixed from one top surface provided by the first fixed net.

Alternately, a larger net 102*d* may be the combined dimension of both the second 102*b* and third nets 102*c* but draped over the support 102*a* thereby providing for a continuous shielded net 'hinge' along the length of the horizontal support, e.g. the first fixed net 102*a* as illustrated in FIG. 2A. In either case, the nets are hung from the top edge of the first fixed net 102*a*. In an embodiment, plastic sheeting or other desirable material, may be used to separate the second and third nets while being fixed to prevent them from bonding one to another. In an alternative embodiment, the fixative or binder has a specific set or gel time that allow fixed fabrics to be separated prior to the bonding mechanism starting. Thus, the second net 102*b* and third net 102*c* as applicable, are fixed or hardened by applying a fixative, e.g. a binder or cementitious material, and are effectively hanging independently, although substantially alongside with the top edges in communication one with another. Thus, the second, and third (or more) nets 102*b*, 102*c* may be supported by or hung from the same single supporting top edge of the first fixed net 102*a*.

In the embodiment illustrated in FIG. 2B, a pole 206 is used to support the second fixed net 102*b* in a substantially horizontal orientation. If the pole 206 is at a suitable height, such as 8 ft, an outer wall can be made by hanging and fixing a net (not shown) from 102*b* at the dashed line such that an overhang 208 is formed. In this manner, exterior walls and gable end walls can be fabricated without any auxiliary supports. The third fixed net 102*c* may also be rotated up as indicated in FIG. 2B. In an embodiment, the third fixed net may be supported with a pole(s) 206 and be used to support a gabled end wall with an overhang 208 if desired. Further, after rotating and supporting both the second and third fixed nets 102*b* and 102*c* forming the roof, all of the interior walls may be hung and fixed, as well as remaining exterior walls. Additionally, all of the doors and windows may be hung utilizing gravity, or directly supported by the wall nets, and indirectly supported by the FOS, and fixed in the desired location. In this case the gravity dictated orientation of doors, windows, etc. can be the mechanism for plumbing these elements.

FIG. 2C illustrates a method of making multiple roof panels. In this example, the first fixed net 102*a* can be used as a support. A second fixed net 102*b* is formed as discussed above and rotated into position as illustrated in FIG. 2B. Next, an unfixed net 201 is hung from the second fixed net 102*b*. The unfixed net 201 is fixed to form a third fixed net 102*c* after rotation to form a contiguous roof with the second fixed net 102*b*. If desired, another net 201 may be hung from lowest edge of fixed net 102*c*, and fixed to form a wall. Alternatively, an overhang 208 (or eave) may be formed by hanging the net 201 in proximity of the lower edge.

Figure 3A:
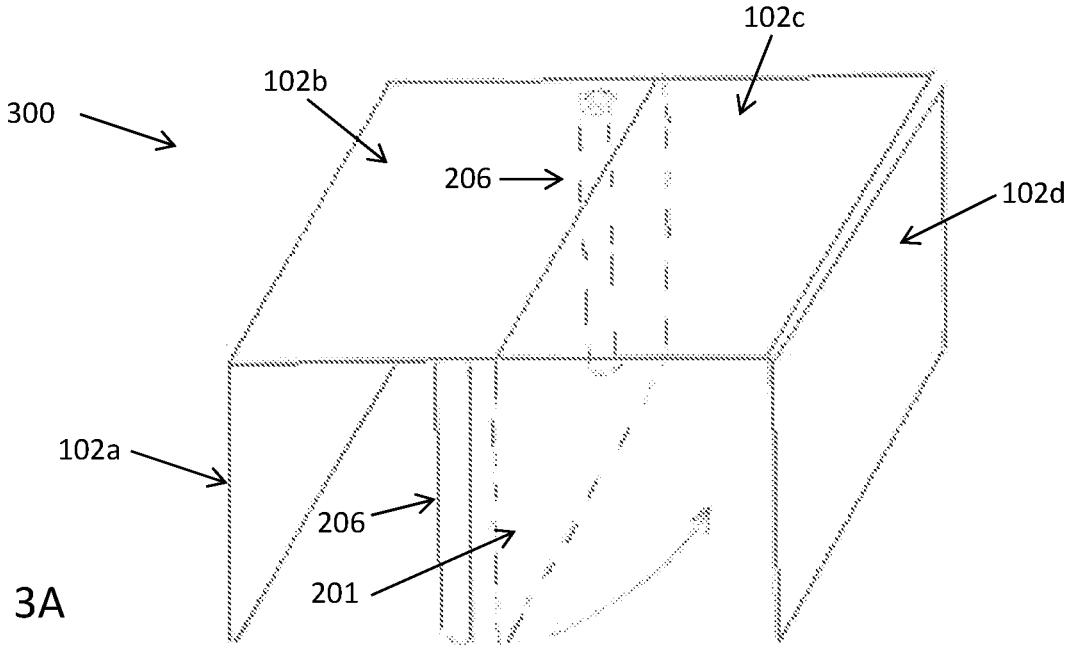
FIGS. 3A-3B are perspective drawings illustrating another embodiment of the method of making a structure.
Figure 3B:
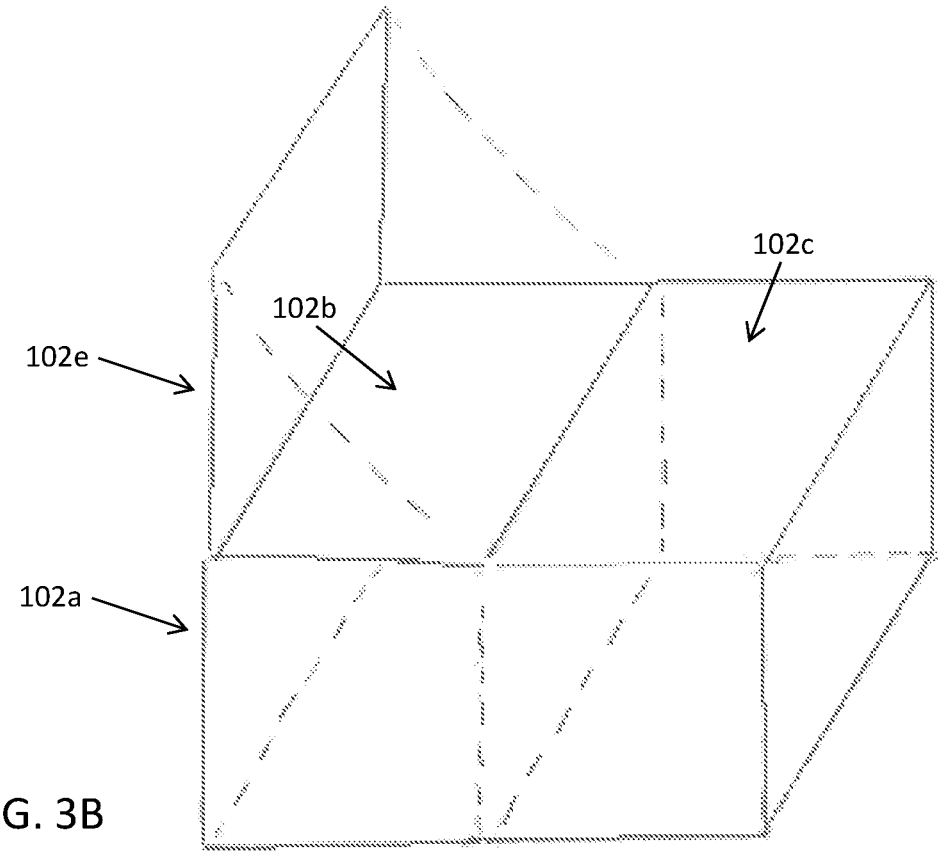
Figure 10:
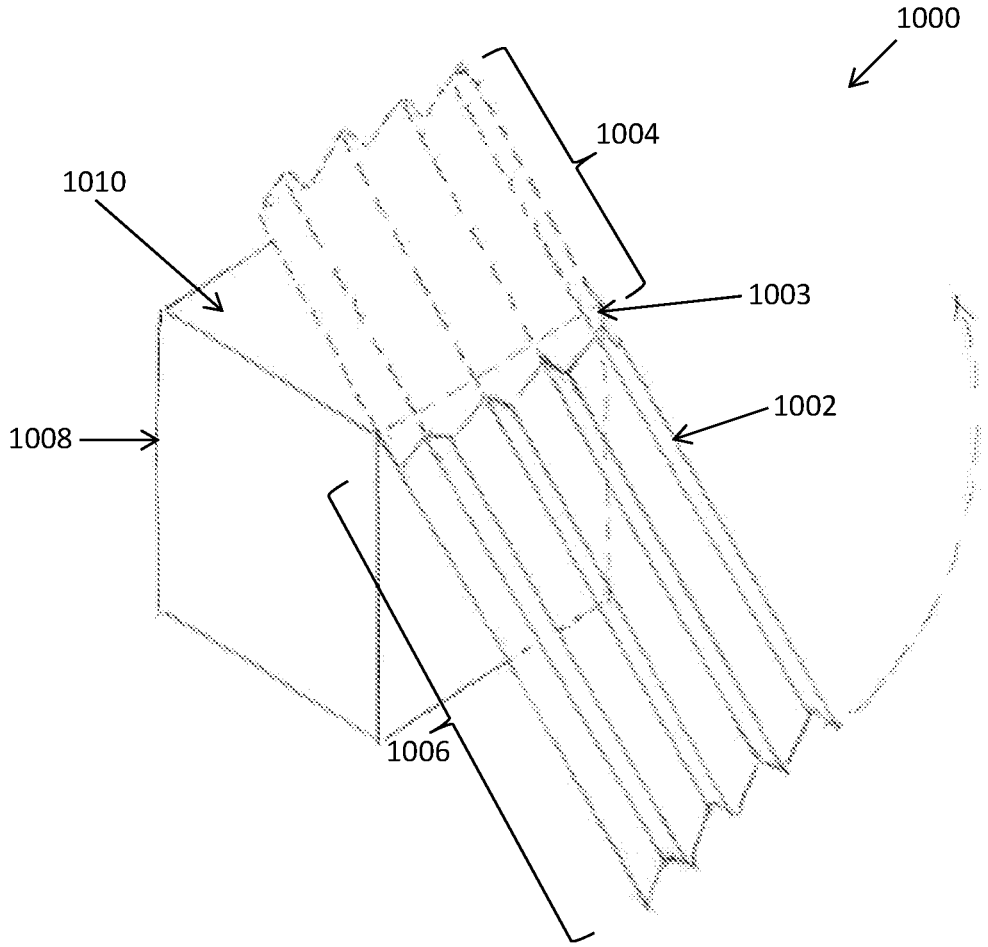
FIG. 10 is a perspective drawing illustrating another embodiment of the method of making a structure.

FIGS. 3A and 3B illustrate another embodiment of the invention. As illustrated in FIG. 3A, a first fixed net 102*a* may be configured as an outer wall of the structure 300. Next, a net is hung from the first fixed net 102*a* and fixed to form a second fixed net 102*b*. The second fixed net 102*b* is rotated to a horizontal position and supported with at least one post 206 to form a first portion of an upper floor or ceiling for the first floor. An unfixed net 201 may be hung from the edge of the second fixed net 102*b* and fixed to form a third fixed net 102*c*. The third fixed net 102*c* may then be rotated up to form a second portion of the upper floor or ceiling for the first floor as illustrated in FIG. 3A. A fourth net may be hung from the outer edge of the third fixed net and fixed to form a fourth fixed net 102*d* that may serve as an outer wall. The post or posts 206 may be permanent or temporary. That is, the posts 206 may be left in the structure 300 to provide added support to the upper floor or removed if deemed unnecessary. This may be done after the hinge is eliminated by applying fixative/binder, or by appropriately placed, such as top & bottom, reinforcing materials 108 as shown in FIG. 10 or both. In an alternative embodiment, the fourth fixed net is rotated up to form a third portion of the upper floor or ceiling and the processes continued until a floor or ceiling of the desired size is fabricated.

FIG. 3B illustrates a further aspect of the embodiment illustrated in FIG. 3A. In this aspect, any number of nets could be hung and fixed from the first horizontal support. As an example, if three nets could be fixed as they hung side by side and then sequentially rotated. One of those nets could be rotated 180 degrees, e.g. fixed net 102*e*, placing it in a vertical orientation above and along the horizontal support, as illustrated in FIG. 3B. The other two fixed nets 102*b*, 102*c* could, as an example without limitation, be rotated into substantially horizontal orientations along the top hinge edge of the first fixed net. These two nets might comprise either a second floor or level or a roof as examples.

Thus, the net first rotated 180 degrees could function as another horizontal support for more nets to be hung from and fixed. It might also function as a wall or some component structure needed at the next above level, which as discussed above, could be utilized to hang more nets to be fixed. After fixing, these nets may be rotated into yet more substantially horizontal orientations. Thus, this sequence can be continued without limit to provide for any number of levels or floors. This is desirable because the first horizontal support is provided for the FOS without the necessity of providing any horizontal support other than the first fixed net. Note horizontal first overhead structure panel 102*b* may not require any compressive load bearing auxiliary support, such as posts, because first overhead structure panel 102*b* can be supported by tensile load bearing supports such as rope or cable from fixed net 102*e*.

As illustrated in FIG. 3A, the first fixed net is rotated, along the axis of the first net support, into a horizontal, or substantially horizontal orientation without being totally detached from the one and only support. To accomplish this rotation, an area parallel to the top fixed edge of the second net is left without fixative by any convenient means. This unfixed area parallel to the top fixed edge of the second net provides a flexible hinge. In the embodiment when one net is hung over and drapes over both sides of the first fixed net as shown in FIG. 2A, the unfixed hinge area extends on both sides of the first horizontal support provided by the first fixed net. These two FOSP's, or parallel fixed nets can be spread apart at their bottom edges and lifted, i.e. opposite rotations from their respective lower edges as shown in 2B. In this manner, the parallel fixed nets are rotated up, producing the desired slope or horizontal orientation for these last two fixed net sections. The two fixed nets are now contiguous and attached one to the other along the length of the common first horizontal support. Alternately, the unfixed tensile load bearing net itself can function as the horizontal support. Thus, these last two rotated nets, being of one piece of net draped over the support prior to fixing, are still attached or in communication by a portion of non-fixed net that acts as a hinge along the first support for rotation of the nets. This unfixed hinge area can be fixed when the nets are in final orientation and/or position of final use.

In an alternative embodiment as illustrated in FIG. 10, two separate nets may be attached to the first support. In an embodiment, the two nets may be affixed directly to each other. Alternatively, the two nets may be attached to one another by placing an appropriately sized strip of material over them and fixing them into a monolithic assembly after final orientation and positioning is achieved. As already taught, the strip of material is not required to achieve a monolithic assembly when the preferred visco-elastomeric or other covalent bonding fixative is utilized. Thus, this embodiment of the method efficiently produces a horizontal floor or roof, or a single pitch roof, or a double pitched roof, or any assembly that can also be defined as FOS. Further, the fixed net or nets can be rotated or adjusted to their position of final use as in the multiple panels comprising an entire overhead assembly, i.e. a roof. This sequence can be repeated as necessary to provide for any size of light weight FOS, regardless of the span limitations of the prior art, because at this point the lightweight FOS has load bearing capacity to support workers. As an example, and without limitation, an 8'×8' lightweight FOSP can be configured with an appropriate tensile load bearing net coated with visco-elastomeric polymer fixative or binder having a compressive load bearing strength of 2500 to 4500 or 4500 to 10,000 psi after being expanded with at least 30% air. In this example, the fixative is approximately ½ inch thick (±1/16 inch) and substantially located on the side of the net to be oriented on top after rotation. Thus, utilizing conventional compressive load bearing materials that are known by those skilled in the art, the total weight of the FOSP may be approximately 213-284 pounds or less with available binders. However, because the FOSP is rotated into position of final use, never lifted in its entirety, the FOSP has an effective weight of 107 to 142 pounds that can be lifted manually without the need for lifting equipment.

Figure 4:
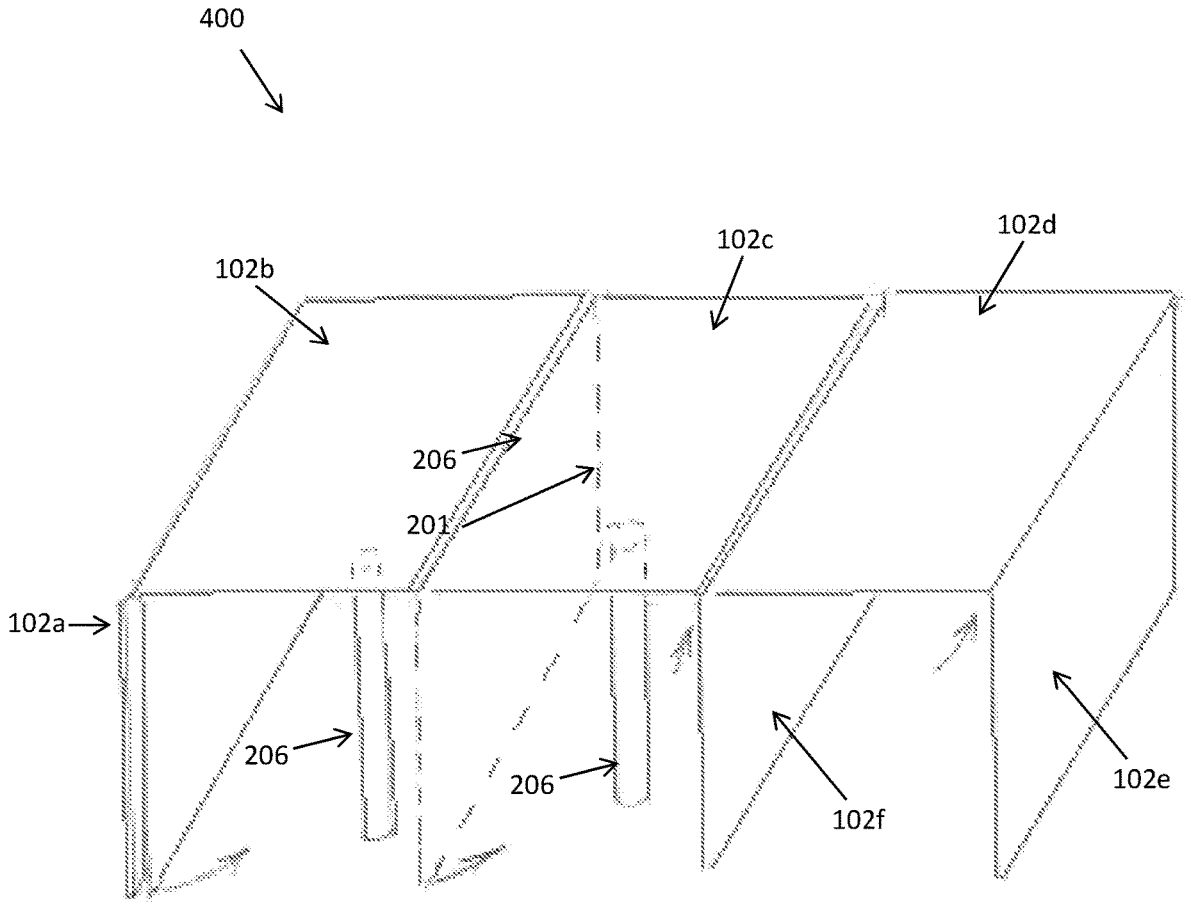
FIG. 4 is perspective drawings illustrating another embodiment of the method of making a structure.

FIG. 4 illustrates another embodiment. In this embodiment, the first fixed net 102*a* comprises an outer wall of the structure 400. The ceiling or first upper floor comprises three fixed nets 102*b*, 102*c*, 102*d*. A fifth fixed net 102*e* comprises another outer wall of the structure 400. The structure 400 may also include an interior wall 102*f* which is at least initially supported by any convenient FOS. In an embodiment only a single support post 206 is provided per overhead panel to provided support. Additional posts may be provided as desired. In an embodiment, the fabric used to form the second fixed net 102*b* may be long enough to form the second fixed net 102*b* illustrated in FIG. 3B and the fifth fixed net 102*e* illustrated in FIG. 3B. In this manner, a single piece of net may be used to form both a floor panel and wall for an upper floor.

Further, 102*a* thru 102*f* may have been single piece of fabric which is hung and fixed sequentially. Utilizing the visco-elastomeric binder specified herein, combined with appropriate tensile material or fabric, the upper floor 102*b*, 102*c*, 102*d* would not need supports 206 to span from wall 102*a* to wall 102*e* after the hinge joints are fixed.

Thus, in view of the foregoing, in an embodiment, the workers (e.g. constructors), can stand on top of the next above level and fabricate an intermediate layer comprising foamed fixative or a folded plate as examples, and/or another fixed net layer as applicable and illustrated in FIG. 3B when fixed net 102*e* is rotated back down on top of first overhead panel 102*b* providing a double layer or second horizontal skin. These additional layers can replace any or all of the temporary compressive load bearing posts, auxiliary supports, or walls comprised of fixed vertical nets that can now be removed and used elsewhere. Or alternately, these fixed sections of net can be utilized, even rotated in place, as the second horizontal skin.

Figure 5A:
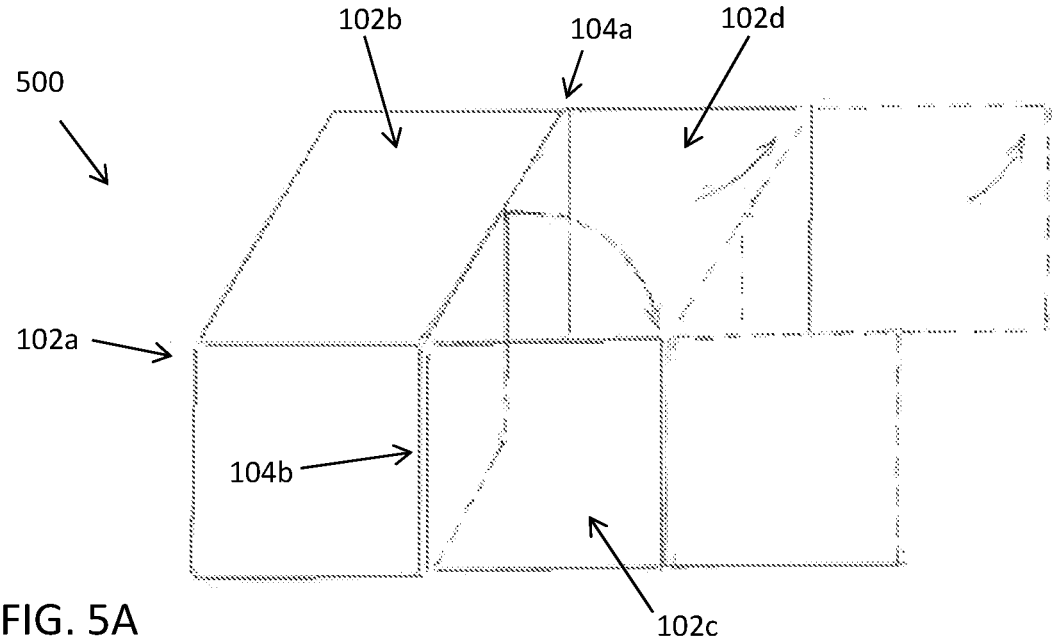
FIGS. 5A-5B are perspective drawings illustrating another embodiment of the method of making a structure.
Figure 5B:
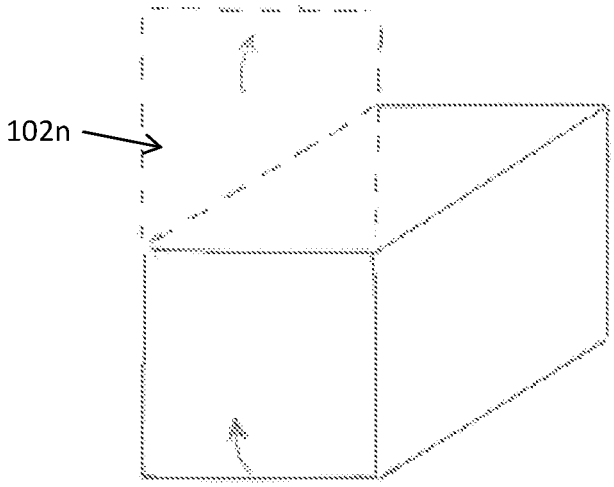

FIGS. 5A and 5B illustrate additional embodiments of the method. This embodiment illustrates how side panels, e.g. panels oriented approximately 90 degrees to the first fixed net 102*a*, can be fabricated by a hanging net methodology. In this embodiment, a second fixed net 102*b* may be formed and rotated in a horizontal position as discussed above. As discussed above, this is accomplished by having unfixed portion 104*a* which acts as a hinge. After hanging the third flexible net, the third flexible net is fixed to form a third fixed net 102*c*. In this embodiment, a second unfixed portion 104*b* is formed along an edge of the flexible net that is oriented perpendicularly to the unfixed portion 104*a* to form a vertically oriented hinge on the side of the fixed net 102*c*. In this embodiment, the first unfixed portion 104*a* of the net is cut. In this manner, the third fixed net 102*c* is freed to rotate to form a side panel as illustrated in FIG. 5A by use of the second unfixed portion 104*b* which acts as a hinge after some of that unfixed portion is fixed to the contiguous vertical panel or wall section. In this manner, a fourth fixed net 102*d* may be formed and rotated to form a side wall opposing the sidewall formed by the third fixed net 102*c*. In this manner, and in combination with the embodiments discussed above, all the walls of a structure may be fabricated by hanging and fixing nets. In an embodiment as illustrated in FIG. 5B, a fixed net 102*n*, where n can be any number, at the end of the structure may be formed and rotated 180 degrees to form an outer wall of a second floor of the structure. The process may then continue as described above and illustrated in FIG. 5A to complete the second floor of the structure. This process may be repeated as many times as desired to make as tall a structure as desired, such as 2-100 floors, such as 2-50 floors, such as 2-25 floors. Even taller structures may be built as desired.

Structure is herein defined as any permanent assembly having at least one tensile load bearing fabric or material combined with at least one compressive load bearing fixative that has the physical capacity to bear, or resist bending within design tolerances, of the ultimate, or design, load or loads applied or anticipated. Further, and in the case of reinforcing layers such as the folded plate discussed above; fabrication can be accomplished while the second fixed net is cantilevered an appropriate distance over the edge of the FOS from which construction is being done upon as illustrated in FIG. 2C.

Further, a double pitched roof may be produced if two nets are hung and fixed from the first single support, or net, and then rotated from vertical orientation to a predetermined roof slope(s). An example is illustrated in FIGS. 2A and 2B. In this embodiment, the one and only first fixed horizontal support would then be at the apex or ridge of the roof depending on the roof design. This single horizontal support 102*a* may be permanent or again it may now be altered, removed and re-used, while vertical fixed nets, or other supports, are fabricated under the double pitched roof.

Further, in another embodiment, the walls that now support the double pitched roof could have been hung or supported by the roof a desired distance inward from the lower edge of the pitched roof. In this way, a roof eave or overhang is provided without the requirement of any bracing or molds to support a cantilevered flexible net while it is being fixed in place. This is the preferred embodiment for fabricating cantilevered fixed nets because no final adjustment is necessary.

In yet another embodiment, the roof eave, or any substantially horizontal surface, can be extended from a substantially horizontal surface, such as a roof, by fixing half or some portion, of a piece or strip of net along the outer edge but leaving at least one inch, such as 1-12 inches, such as 2-6 inches, of the existing roof beyond the fixed net. After fixing a portion of the flexible net, fold the remaining unfixed net back over the fixed net with a shielding material between the two if necessary and fix that remaining net. After curing or hardening of the fixative, the last fixed net can be unfolded and cantilevered over the edge providing an eave or extended floor area without the need of forming or bracing.

The hinge strip may then be fixed. Alternately, the 'overhang part', or eave, might be fabricated from a 3 foot wide, as an example, strip of excess unfixed fabric left hanging vertically. The lower 2 feet of excess fabric would be fixed. In this example, a 1 foot hinge strip would remain in between the fixed fabric to be rotated and the roof. This 1 foot hinge strip can then be folded back onto itself and fixed on top of the roof, allowing part of the fixed eave potion to be fixed on top of, or contiguous to, the roof. If desired, an addition strip of reinforcement can be fixed along the hinge area of the eave so constructed.

In another embodiment, multiple roof or floor panels for longer spans are fabricated without height (size) or weight limitations for the rotation process. This method repeats the employment of the outside edge (i.e. bottom edge before rotation) of the last rotated section as the new single horizontal support for yet another roof or floor section of un-fixed net to be suspended therefrom without any auxiliary horizontal support. Thus, this sequence can be repeated as many times as necessary to produce any size of roof or floor in situ without the labor and material cost of multiple horizontal supports. Auxiliary horizontal net supports and support systems (framework) are replaced by the substantially horizontal 'outside' edge of the last fixed and re-oriented, if necessary, net section. Therefore, once the first section is rotated, if desired, into the desired orientation or position, auxiliary horizontal supports are not required as the roof, which acts as the FOS, is lengthened and/or expanded in width without limitation. This last feature eliminates the need for any more 'first' fixed horizontal supports to support the next panel section to be fixed and then utilized as the FOS. Alternatively, if the panel is not rotated, it can be utilized for other purposes.

It has been found advantageous, when utilizing repetition of the above described methods of fabricating large floor or roof sections without limitation to size, that it may be more efficient and structurally desirable to shield or mask off some area of net along the length of the bottom, or 'outside' edges on either side so that it does not get fixed. The terms mask or shield are defined as any technique by which an area of tensile load bearing net is prevented from being coated or treated with the fixative. Another common term in the construction industry is to 'mask off' an area that is not to be treated with fixative. Thus, in an embodiment, another section of unfixed net can be lapped over and fixed to the masked off portion of the previous fixed net much like traditional steel rebar is lapped. This is an embodiment of a method to accommodate the continuation or fabrication of multiple net sections into one continuous fixed net in a monolithic fabrication process. In an alternate embodiment, the binder or fixative covalently and monolithically bonds an unfixed net to a fixed net without the need for masking or splicing in additional strips (108) of nets as shown in 1C. In this manner, multiple roof sections and/or FOSP's can be monolithically cast or fixed providing one uninterrupted continuous length of fixed tensile load bearing net. This feature is required for tensile load bearing elements pursuant to construction protocols such as IBC (International Building Code) and the ACI Code (American Concrete Institute Code). The length of flexible net is only limited by the size (diameter) of the roll of net. Thus, a magnitude of length might be in excess of 300 feet or 1,000 feet before a splice, a fixed lap, or simply the covalent bonding of contiguous fixed or unfixed fabric to effectively provide fabric continuity to resist tensile loads applied pursuant to applicable engineering protocols and guidelines established by building codes or other regulatory agencies.

Continuous fixing of an uninterrupted roll of fabric provides labor savings. This eliminates splicing, resulting in significant cost savings previously required by labor (time) and material expenditures. However, to accommodate a change of plan or the need for more than one net, in an embodiment, the method of shielding a portion of net can provide an unfixed area where yet more unfixed net can be overlaid and fixed in combination with the first shielded net, thus effectively providing a method for splicing the tensile load bearing net into multiple nets or alternately covalently bonding the nets in communication one with the other as needed. This also applies to extremely large roof or tall wall assemblies of sections which would be longer than the roll of net. In this embodiment, a 'splice' is made so as to make the tensile load bearing net a continuous load bearing element of the layer or assembly.

As is known in traditional/conventional pre-cast concrete construction practice, the length (span or size) of pre-cast floor, roof, deck, or bridge section is limited to the legal and physical capacity of the cranes, trucks, roads, bridge capacities, etc. that are encountered when moving, or transporting large reinforced concrete assemblies or long span elements from a remote production facility to the job site. Further, and especially in the case of bridge construction, although a mold with all of the necessary supporting framework can be fabricated on site; the limitation of spans for such molded concrete or steel beams is well known, if for no other reason than the fact that the weight handling capacity and height/reach limits of cranes utilized to pick up and place such beams is extremely limited. However, embodiments of the present invention overcome this limitation because the product fabrication is in situ.

In an embodiment, spans from 8 feet to 600 feet, or more, can now be efficiently fabricated utilizing the in-situ fabrication methods herein disclosed. Further, and in the case of floor, deck, or roof applications, monolithic structural load bearing elements having lengths or spans of 8 feet to 2,000 feet or more, and widths of 8 feet to 1,000 feet or more can be efficiently constructed in situ utilizing minimal physical labor without the need for heavy construction equipment such as cranes, wide and long load tractor trailers, etc.

In an embodiment utilizing one uninterrupted length of net; the only work required at the interface of two contiguous fixed sections, after being rotated adjusted into final orientation, is the application of the compressive load bearing fixative or binder at the 'hinge' or interface. This fixative is the compressive load bearing element and as such is not required to be applied in this area at the same time as the fixing of the two pieces of net. Alternately, the fixative may have the capacity to covalently bond with either or both the net and the previously placed fixative, creating a monolithic composite. The preferred embodiment of a covalent bonding fixative eliminates 'cold joints'.

An embodiment of the method provides for fast and efficient construction or fabrication of, for example, walls, floors and roofs. By replicating the fabrication of FOSP's according to the methods as disclosed herein, the speed of construction of any size of structure, with any load bearing requirement, may be accomplished with minimal labor, no heavy equipment and in approximately 1/10th, such as 1/4 to 1/20th, such as 1/8 to 1/15th, the time of prior art or traditional construction methodologies.

As an example, and without limitation, an 8'x8' FOSP can be fabricated and be placed in position of final use in 3-11 minutes as delineated in the following steps:

| | |
|---|---|
| Hang tensile load bearing net | 1-2 minutes |
| Apply compressive load bearing fixative | 1-5 minutes |
| Rotate fixed FOSP into final position | 0.5-2 minutes |
| Support unsupported opposite end of FOSP | 0.5-2 minutes |

That is, fabrication of 64 sq. ft. of floor or roof can be accomplished in 3 to 11 minutes (depending on fixative set time noting that in a preferred embodiment utilizing a visco-elastomeric fixative the total time would be approximately 3 minutes). The time saving feature of the disclosed product is a function of the process and thus inseparable from the process. This is because the visco-elastomeric fixative product is dependent on the rapid gel and set times never before disclosed in the prior art. And conversely, the FOS method is dependent upon the rapid gel and set times. Thus, one is dependent upon the other.

Therefore, as an example, from 349 sq. ft. up to 1,280 sq. ft. of roof or next overhead floor can be constructed by 2-3 workers per hour without cranes, telescoping forklifts, ladders, scaffolding, man-lifts, etc.

These numbers are conservative because in the case of walls, the 'rotation' and 'support' steps are eliminated. Thus, in the case of walls from 548 up to 1,920 sq. ft. can be fabricated and in place of final use in one hour by 2-3 workers and without the need for heavy construction equipment, ladders or scaffolding.

The ability for 2 or 3 workers to fabricate this much structure in such a short time is unprecedented. Additionally, unprecedented is that this production or fabrication speed is not just achieved horizontally; the methods described herein provide for the comparable speed of fabrication vertically. That is, multiple floors or levels may be fabricated as opposed to merely a larger structure foot print. Preferably, the binder or cementitious compressive load bearing fixative has an extremely fast set, or cure, time i.e. curing from flowable plastic phase to the gelled phase in 1 to 5 minutes, such as 2 to 4 minutes. And further achieving adequate compressive strengths of 1500 psi to 4500 psi in 2 to 4 minutes to accommodate the continuous sequential fixing of nets without auxiliary braces, formwork, or molds as taught herein. In a preferred embodiment, a covalent bonding fixative is utilized which achieves these compressive strengths while at the same time having been expanded with up to 30% air. Thus, in a preferred embodiment, the fixative yields high compressive strength in a very short time and at the same time is very lightweight due to air entrainment. Another feature of the fixative or binder is tensile load bearing capacity from 100 psi to 29,000 psi, such as100 psi to 500 psi or 500 psi to 29,000 psi.

In yet another preferred embodiment, the bonded basalt filament matrix, fabric, net, or rebar comprises the same binder as the cementitious or compressive load bearing fixative in the preferred embodiment having the visco-elastomeric polymer compressive element or fixative.

In an embodiment where spans or loads dictate more depth of member, the FOSP sections can have depth of member conveniently and quickly added by the workers as taught herein without the need for scaffolding, ladders, or lifting machinery.

In another embodiment of the method of utilizing the last fixed edge, after the last floor or roof section is rotated into position, the last fixed edge is used to hang or support an unfixed net at or near the edge. This support element at the last outer fixed edge, or proximity there-to, now becomes the only support for a section of unfixed net that will remain in the vertical position as its final orientation after being fixed e.g. walls.

Further, in another embodiment, to avoid any wall height restrictions and to avoid the cost of working at heights over 8 ft that would require ladders, scaffolding, telescoping fork lifts, and such equipment; the lower edge of the wall net is 'shielded' to provide for yet another section of net to be horizontally supported in a vertical orientation by the bottom fixed edge of the wall section just fixed. Alternatively, and in a preferred embodiment, the visco-elastomeric polymer fixative has covalent bonding characteristics eliminating the need for 'shielding' and subsequently splicing. The next section of wall is easily accommodated for by simply raising the FOS, thus raising the attached last fixed wall section, the desired distance. As an example, and without limitation as illustrated in FIG. 1A fixed panel 102*a* can be raised by any convenient means such as and without limitation; a pulley system from the top of poles 106. Once 102*a* is at the desired height another section of net can be covalently bonded thereto or fixed as taught in FIG. 10. Alternately the panel 102*a* fabric was not cut or separated from the roll of fabric along the bottom edge thus providing one continuous uninterrupted fabric from the roll as the fixed fabric is lifted incrementally by any convenient means. And further, as discussed in more detail below, moving a conical roof FOS further up the single support pole at the center or apex thus lifting the remaining unfixed net into a substantially vertical orientation to be fixed. Further, this process can be repeated until the desired wall height is achieved without the need for ladders, scaffolding, telescoping forklifts, etc. In an embodiment, the wall sections can have additional layers applied as desired, before they are raised.

Fabricating flat planar, and ultimately substantially horizontal, floor or roof products above the ground and in situ without molds or multiple supports has never been done before and is thus new to the construction industry. An advantage of the methods disclosed herein is that the planar floor or roof sections do not require an additional flat surface to be cast against (e.g. a mold surface and/or framework/supports). Further, these roof or floor panel products are already in situ, in position of final utilization, optionally with an adjustment to final position. The improved methods also eliminate the necessity of having to disassemble and remove the previously required supports, framework, and molding surfaces of conventional building methods. As is apparent the terms FOS or FOSP in this construction sequence are interchangeable with finished and ready to use floor or roof construction products.

In another embodiment, the load lifting requirements are reduced by at least 40%, such as at least 50%, noting that an adjustment in orientation by rotation requires only half the load lifting capacity, horsepower or force previously required because the multiple floor or roof sections can simply be rotated into final position. This is opposed to known construction technologies wherein the entire weight of the floor or roof section must be borne or lifted to re-orient or re-position the floor or roof section. Further, this percentage increases proportionally as multiple roof or floor sections are rotated into position as in the previously described sequence for spans of great length.

In yet another embodiment, an intermediate core layer, if desired, can be applied while the first fixed net is still in a vertical or substantially vertical orientation before being rotated. In an embodiment, a second external net skin can also be applied over the intermediate core layer in this orientation, or any orientation, if more convenient. Thus, for example and if desired, an intermediate layer and a second net layer can be applied to the un-shielded fixed sections in the conical shaped roofs, etc. The invention assumes that lifting equipment may be utilized with any teaching or method according to the invention as may be convenient or desired.

Alternately, only the first net layer of a first above section is fixed in the vertical orientation before rotation. Then, any additional layers can be applied after adjustment of orientation and/or position.

Figure 12A:
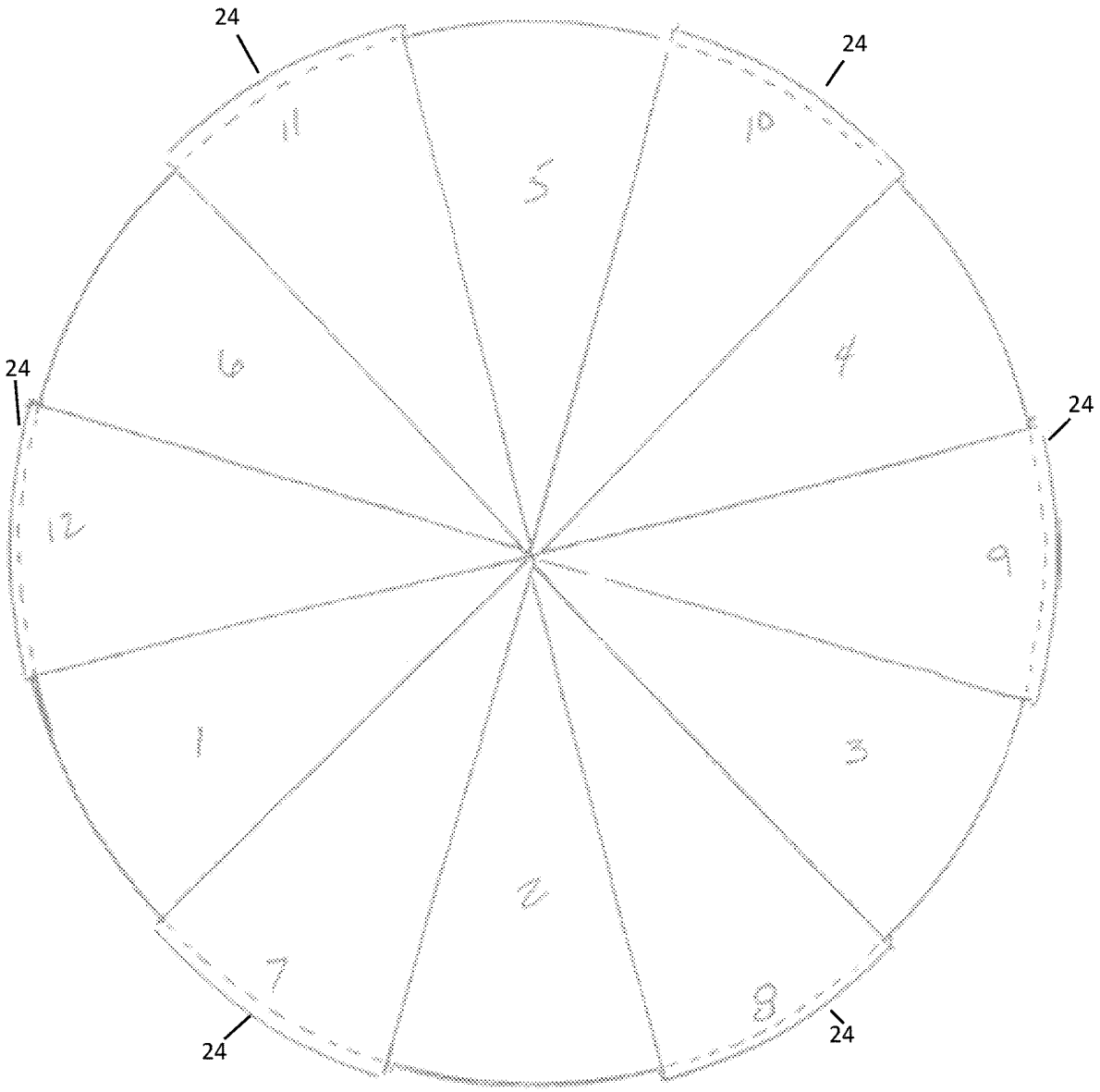
FIGS. 12A-12C are schematic diagrams illustrating a method of making a conical roof according to an embodiment.
Figure 12B:
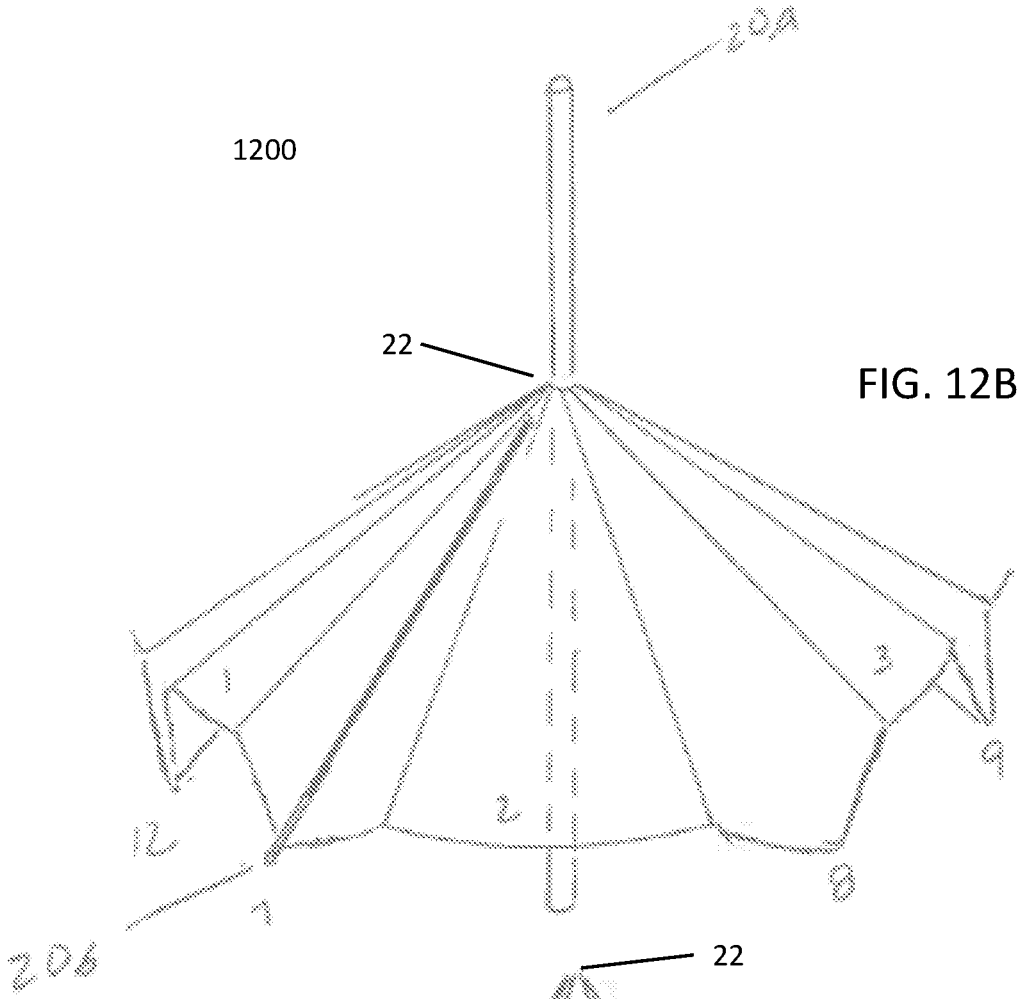
Figure 12C:
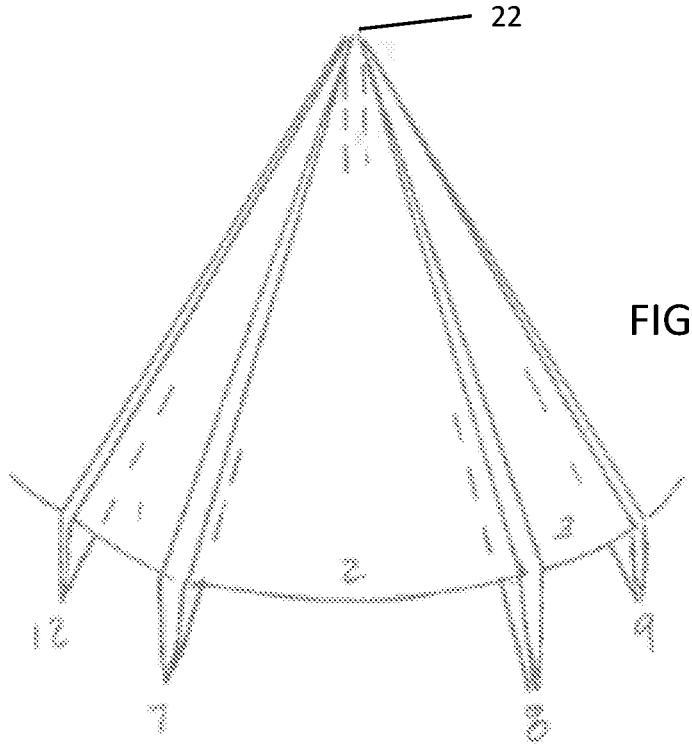
Figures 14A, 14B, 14C, 14D, 14E, 14F, 14G, 14H, 14I:
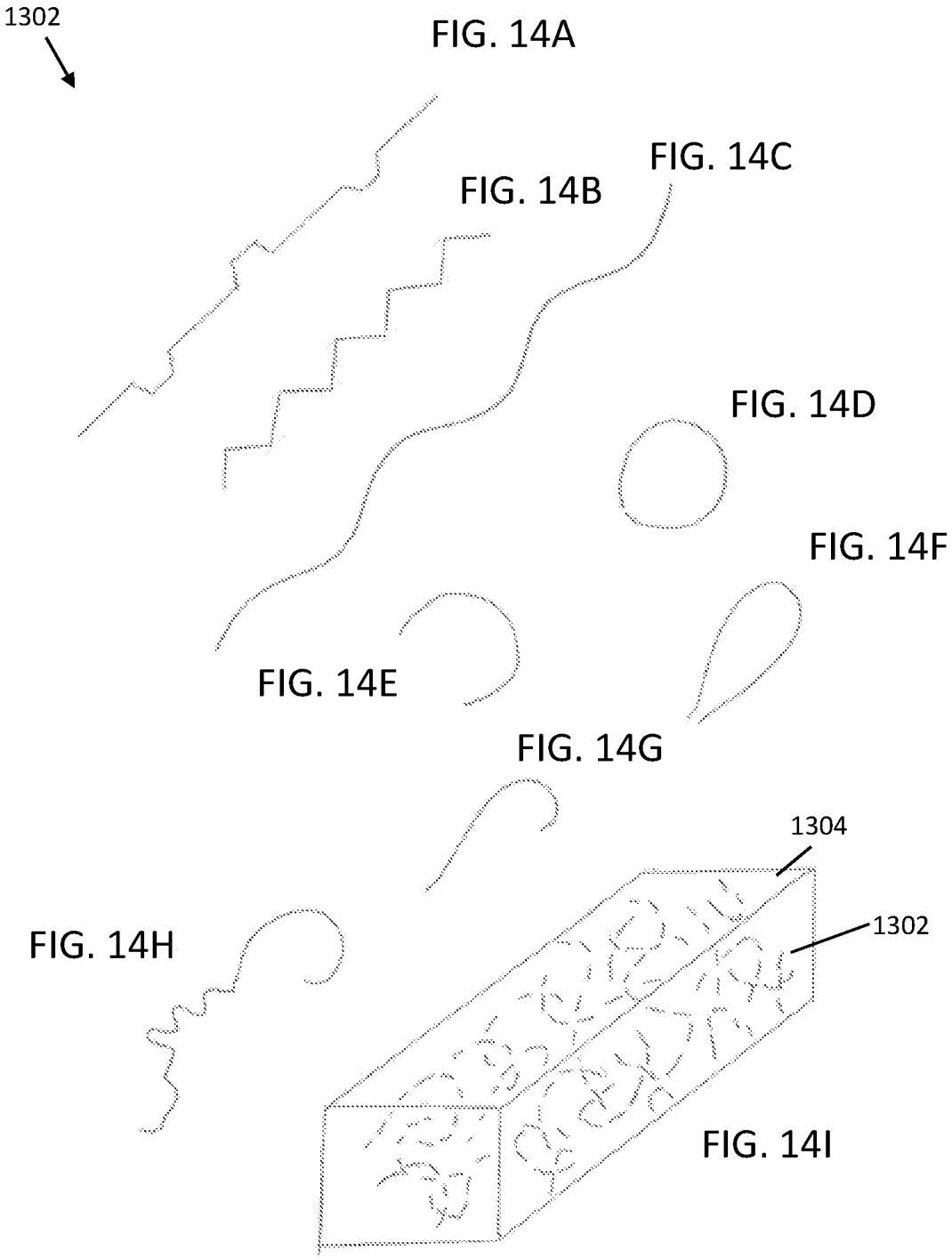
FIGS. 14A-14H are schematic illustrations of bent and/or kinked basalt fibers according to various embodiments.
FIG. 14I is a schematic illustration of a basalt rebar according to an embodiment.

Thus, the inventor has discovered that by limiting the work height to approximately 8-9 feet results in significant savings in time, labor and material by eliminating the necessity of tall ladders, scaffolding, overhead cranes, telescoping forklifts, temporary roof or floor supports and framework, and the inherent risks and danger to workers when working off of, or above ground level. Again, this may be accomplished by keeping the vertical dimension, or incremental dimension, of a net to be fixed, to 6 or 8 feet, or 8 to 9 feet. Or alternately, by an adjustment in the elevation of the FOS which would lift the previously fixed vertical net(s), as an example wall sections, in increments of 8-9 ft. or less for example. This may be particularly useful in the construction of round, or substantially round, structures where the conical FOS is supported by one central pole which runs through a central hole in the conical FOS vertically allowing for said vertical adjustment from the ground via a simple rope or cable pulley system, as illustrated in FIGS. 12A-12C and discussed in more detail below.

Advantageously, the elimination of a remote fabrication facility for such building products, components or sections, provides for the elimination of costs associated with storage, loading, hauling, off-loading, and placement of such component sections. Even more efficiency may be achieved by the elimination of all of the heavy equipment and associated fuel consumption required by such an exercise. Further, the capacity to increase the span, or size, in situ, of any load bearing building section, or multiple combined sections, having uninterrupted lengths of tensile load bearing net whether masked and spliced or simply lapped and covalently fixed in preferred embodiment was not previously possible within the prior art disclosures.

Thus, multiple advantages as noted, are attributed to the novel ability to fabricate the first tensile load bearing net combined with the first layer of compressive load bearing material without the necessity of multiple supports as disclosed in the prior art. Further, these novel methods provide the finished product, the supporting framework and structure, or a mold for additional materials and shapes without the necessity of multiple supports as taught in the prior art.

After the roof, or floor, FOS has achieved all or a sufficient amount, such as 60%, such as 95%, of its' load bearing capacity by virtue of the cure time, the first tensile load bearing 'wall' net can be hung from the FOS already in place above. This wall net does not require any temporary framework or support from which to hang it in position while being fixed.

In another embodiment illustrated in FIG. 2C, the exterior walls are positioned or hung in 'proximity', or off-set, to the most outside or exterior edge of the FOS. This allows for a roof eave, or overhang, to be fabricated in situ without supports, braces, or molds even though this part of the roof is, or may be, in a cantilevered final position. The ability to cast reinforced flowable cementitious materials that are cantilevered, without a mold or any support, has never been accomplished within the prior art. Further, interior substantially vertical (such as less than 5°, such as less than 3° from vertical) unfixed nets can be hung, or supported, by the FOS while being fixed.

Figure 11A:
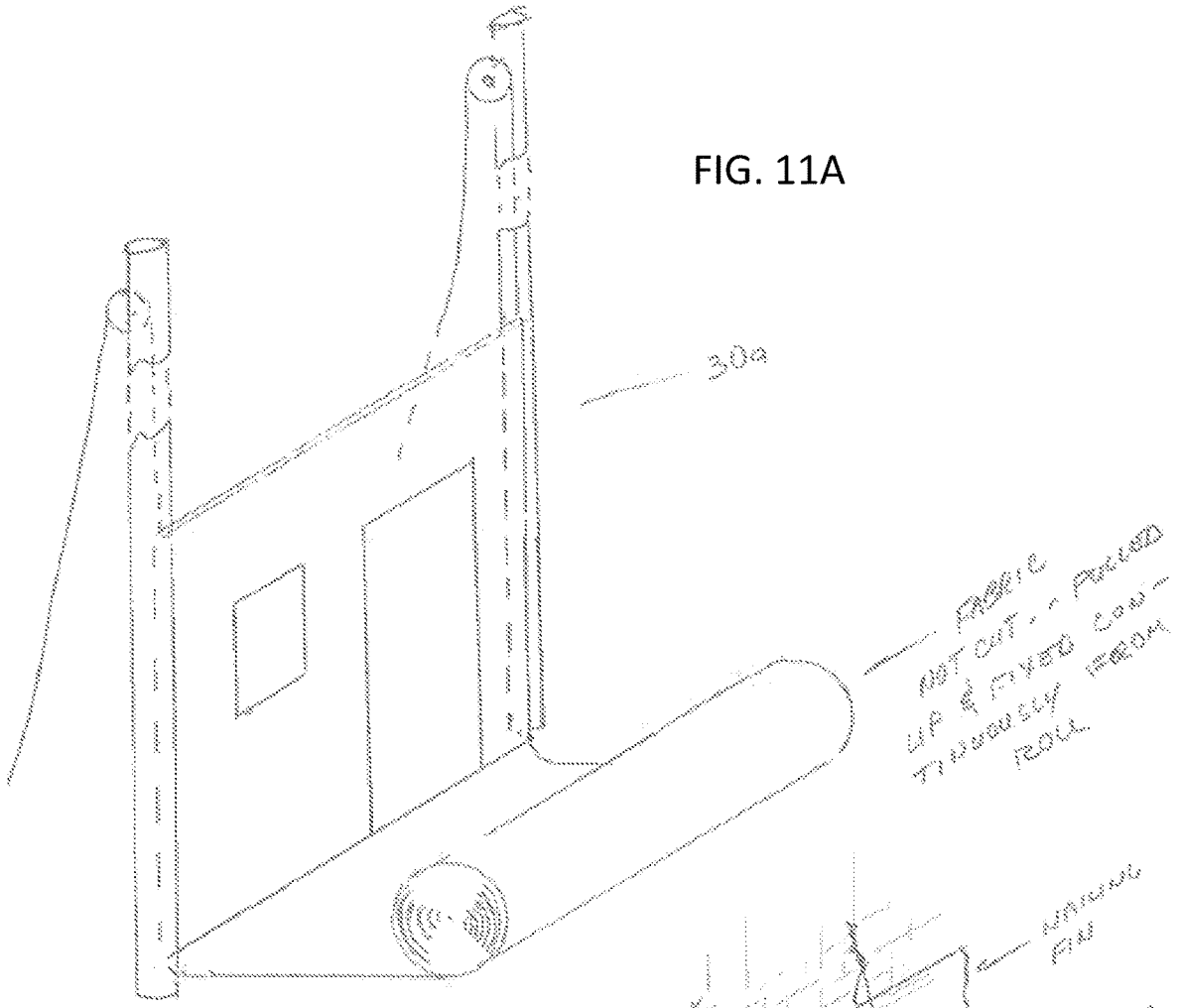
FIGS. 11A and 11B are schematic diagrams illustrating a method of hanging windows and doors according to an embodiment.
Figure 11B:
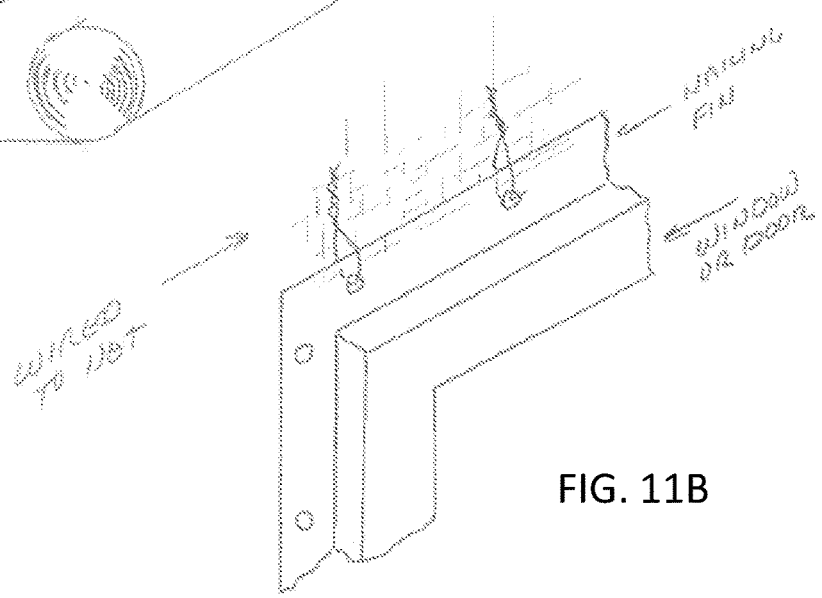

In an embodiment illustrated in FIGS. 11A and 11B, a window can be hung at any convenient location on the unfixed net that will become the wall or vertical section 30*a* after fixing. As an example, the window is attached to the net by any convenient means such as tie wire, adhesives, visco-elastomeric fixative, etc. FIG. 11B. Subsequently after the net is fixed, the window is monolithically cast into place on, or, 'in' (if an opening is cut to accommodate the size of the window unit) the vertical section 30*a*. As an additional advantage vertical section 30*a* might be raised, as to accommodate a second floor. Thus, the window has been installed at the level of the second floor without the workman leaving the ground or working from ladders or scaffolding. Similarly, door frames, without nailing fins, can have nails, or any convenient fixture, attached along the surface to be fixed with the fabric. All amenities such as doors, windows, plumbing, electrical, cabinets can be hung or supported from the FOS via the unfixed, or fixed, net or other tensile load bearing element and thus fixed in place within or adjacent to the unfixed net during the construction sequence. Alternately, any tensile load bearing element might be utilized to suspend the amenities in position. Fixing in place may be accomplished quickly and easily by mechanical attachments such as nails, screws or wires, etc. being attached to the door frames/jambs or to the window nailing fin to hold the part in the desired location while it is being fixed in situ. Once the surrounding net is fixed, the nails, screws, wires, nailing fins etc. become part of a single monolithic cast in place entity with the fixed net. In an embodiment the windows and doors can be provided 'shrink-wrapped'. Thus, in an embodiment comprising window and door installation, the shrink wrap can be left intact and in place during fixing. The shrink wrap can function as a shield or masking material that protects the windows and doors from the fixative while the fixative is being applied to the surrounding net. Another advantage of having masked off windows, doors, and other amenities is the labor and material savings for other construction tradesmen such as dry wall contractors and painters who typically have to mask off doors and windows. Thus, leaving the shielding or masking in place represents significant labor, material, and time savings for these tradesmen.

In another embodiment, a core or intermediate spacer layer can be applied to the first fixed net that is supported by or hung from the FOS. Or alternately, the intermediate layer, such as a folded plate, can be hung from the FOS alongside and contiguous to the first fixed vertical net and then fixed causing the first fixed net layer and the intermediate layer to be one covalently bonded monolithic cast entity. Subsequently, the second or opposite external skin or layer, i.e. exo-skeleton configuration, can similarly be supported by the FOS or simply applied over the intermediate core layer and fixed. Alternately, other fixatives, whether covalent bonding or not, can be utilized within the teachings of this invention.

Figure 6:
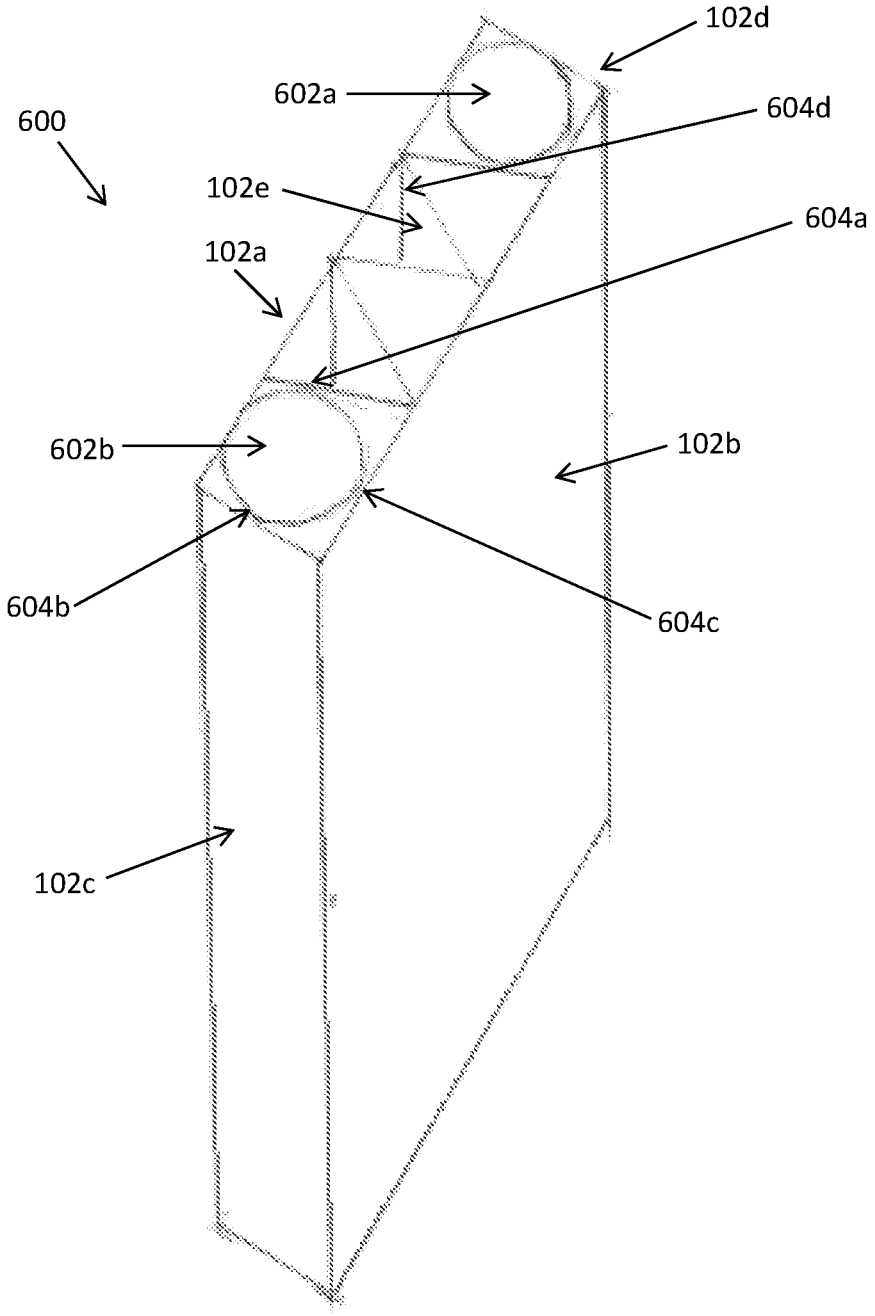
FIG. 6 is a perspective drawing illustrating an embodiment of the method of making a folded plate according to the invention.
Figure 7A:
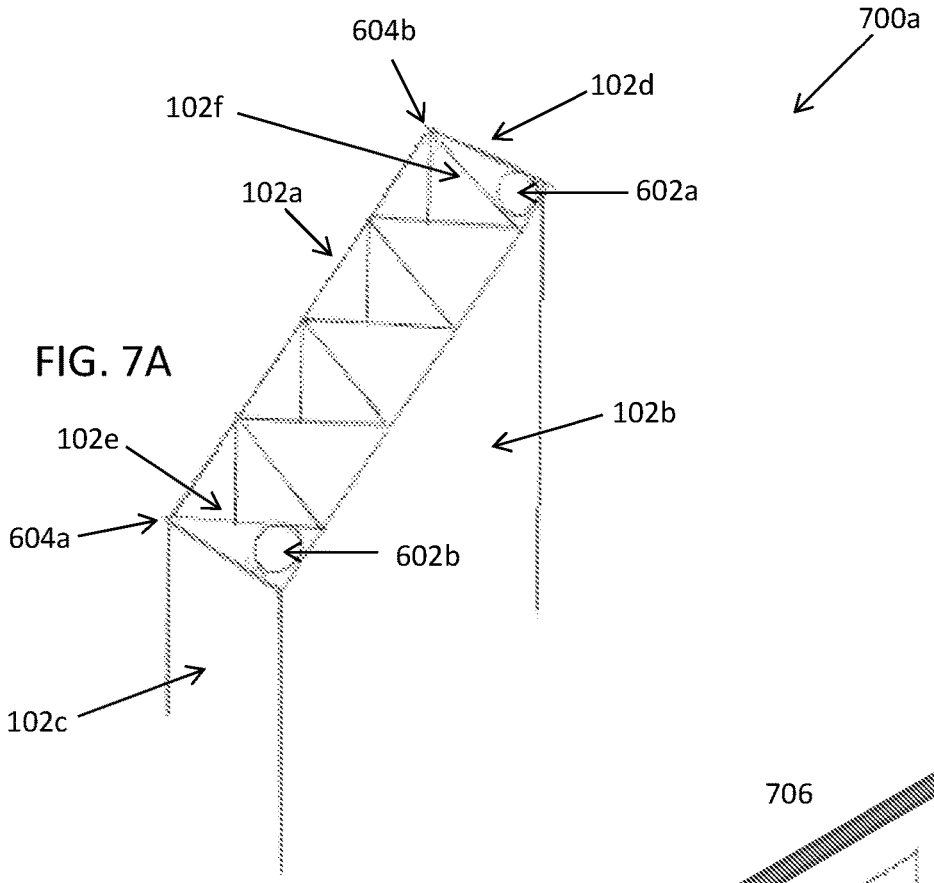
FIGS. 7A and 7B are a perspective drawing illustrating an embodiment of the method of making a folded plate according to the invention.
Figure 7B:
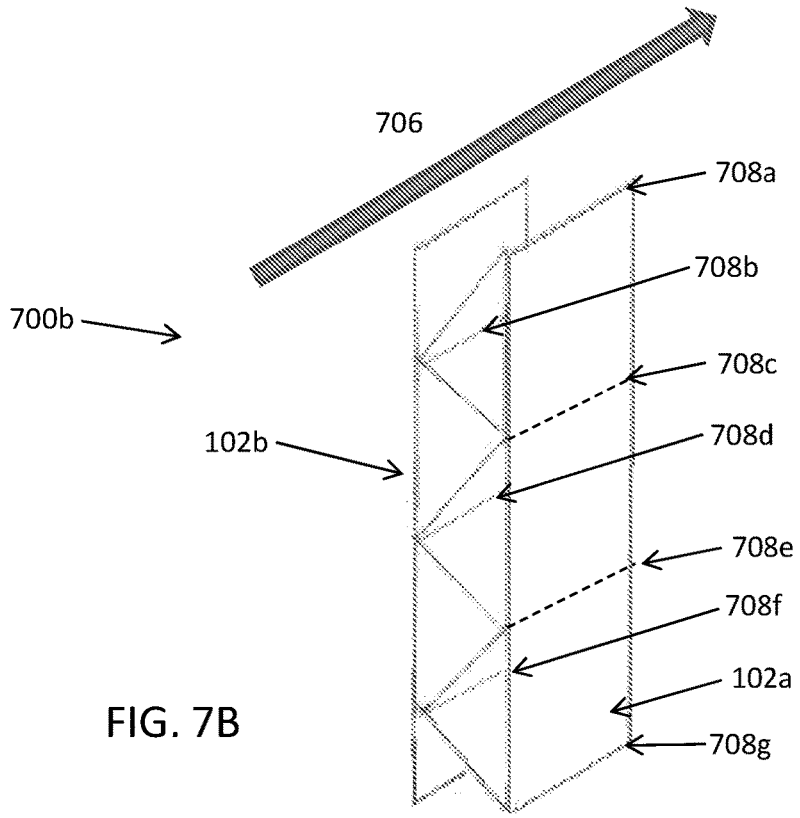

FIGS. 6, 7A and 7B illustrate embodiments of fabricating folded plates 600, 700*a*, 700*b*. In the embodiment illustrated in FIG. 6, two support columns 602*a*, 602*b* are provided. The first fixed net 102*a* may be formed by supporting a flexible net with the support columns 602*a*, 602*b* or hanging the flexible net from the first overhead support available and then applying the fixative. Fixed net 102*e* is a panel of a set of folded plates which can be fabricated individually in situ by the method illustrated in FIG. 5A or with the equipment illustrated in FIG. 8 or by the method illustrated in FIG. 10 and discussed in more detail below.

The folded plate 600 may or may not be fixed to the support column 602*b* at point 604*a*. Thus, a hinge point for the folded plate 600 may be located at the point 604*a*. In this embodiment, it is unnecessary to hinge a panel from fixed net 102*a* at point 604*d*.

Thus, depending on the use of the support columns 602*a*, 602*b*, 0-4 fixed net wall panels, 102*a*, 102*b*, 102*c*, 102*d* can be fabricated in situ with or without the folded plate structure. Additionally, the fixed net wall panels, 102*a*, 102*b*, 102*c*, 102*d* can be fixed to each other. In an embodiment, the fixed net wall panels, 102*a*, 102*b*, 102*c*, 102*d* are fixed to each other and are used as a form or mold to contain added flowable material, such as concrete or other fixative. The fixed net wall panels, 102*a*, 102*b*, 102*c*, 102*d* may or may not contact the support columns 602*a*, 602*b*. In an embodiment, the fixed net wall panels, 102*a*, 102*b*, 102*c*, 102*d* are used as a form without the addition of the folded plate 600.

FIG. 7A illustrates another embodiment of folded plate 700. As in the previous embodiment, this embodiment includes two support columns 602*a*, 602*b*. However, in this embodiment, the fixed nets 102*e*, 102*f* of the folded plate 700*a* meet and are affixed to points 604*a*, 604*b* located at corners of side sidewalls 102*a*, 102*c* and 102*c*, 102*d*, respectively.

FIG. 7B illustrates an embodiment of a folded plate 700*b* in which the longitudinal axis 706 of the folded plate 700*b* is oriented in a horizontal direction rather than a vertical direction. The folded plate 700*b* of this embodiment may be located between support columns 602*a*, 602*b* in a similar fashion to the folded plate 600 of the embodiment illustrated in FIG. 6. Alternatively, the folded plate 700*b* may be surrounded with fixed net wall panels, 102*a*, 102*b*, 102*c*, 102*d* without support columns 602*a*, 602*b*.

To make the folded plate 700*b*, a flexible net may be hung from fixed net 102*a*, such as at the top edge 708*a* fixed net 102*a*. Before fixing the flexible net comprising the folded plate 700*b*, strips of flexible fabric are masked off or shielded from the fixative at portions 708*b*-708*f*. These strips of unfixed flexible net act as hinge points to rotate the fixed plates into the desired folded plate configuration. The plates can be rotated and have the hinge strips fixed in sequence. Optionally, the second fixed net 102*b* can be supported from above or from the folded plate 700*b* and fixed in situ. In an alternate method the folded plate fabric is similarly masked off separating the fabric sections to be fixed. However, in this method all of the 'plates' or unshielded sections are fixed at the same time in the vertical orientation and before rotation. Then, after fixing the individual plates can be rotated into position and fixed in sequence.

Figure 8:
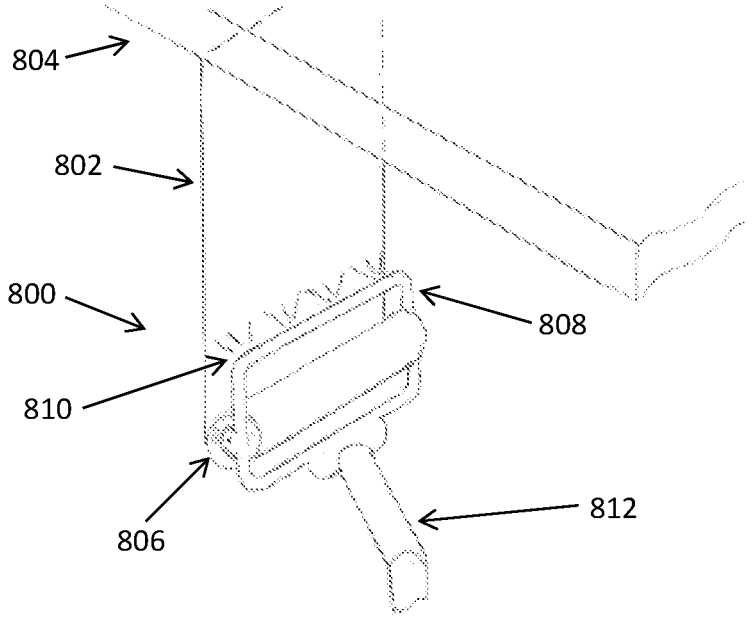
FIG. 8 illustrates a device 800 that can be used to make fixed flexible nets according to an embodiment.

FIG. 8 illustrates a device 800 that can be used to make fixed flexible nets for any of the embodiments above. The device 800 includes a frame 808 which includes a central rod or roller 806 configured to receive a roll of flexible fabric 802. The fabric may be supported from a support 804. The device 800 may include one or more nozzles 810 to provide fixative to the flexible fabric 802. The nozzles are not limited to spray nozzles but are representative of one embodiment that delivers fixative to the net. The fixative may be applied after the fabric leaves the roll or alternately the fixative can be applied to a controlled area of fabric before the fabric leaves the roll. This last method can mitigate, or eliminate, sagging and distortion of the fixed fabric after coating with fixative or an overcoat. Again, it should be noted that in a preferred embodiment utilizing fast setting and tensile load bearing visco-elastomeric polymer most, if not all, sagging and distortion can be eliminated. The fixative or overcoat may be provided to the device via a conduit or hose, with or without (as an example) an articulating arm 812 that can act as the deployment or means of manipulating and positioning the device 800, even remotely if desired. Alternately, the fabric may be run through a coating box after it is off the roll. The coating box contains flowable fixative and may be a totally closed vessel with only tight slits which allow the fabric to enter and then exit after being coated with flowable fixative.

In an embodiment, any additional interior walls, gable end walls, rake walls, doors, windows, or most if not all other construction elements or components can also be suspended, and fixed, in situ utilizing only the FOS for positioning and supporting in situ as provided for in this embodiment, without the necessity of providing any ancillary supports as used in conventional building practices which utilize supports and braces to hold and plumb such additional parts and components in place. In an embodiment, roughing in electrical wiring (e.g. Romex®) may be accomplished laying the wiring along the bottom inside of the first fixed wall panel while maintaining any code required space from the most external fixed net surface. Further switch legs, outlets, overhead lighting wiring, metal or plastic conduits etc. can be attached to the interior side of the wall panel as desired. Wiring, and similarly, plumbing rough in time may be reduced by up to 90%, such as 50-90% compared to the time required to bore holes or cut chases for electrical wiring, or plumbing rough-ins.

In an embodiment, an entire building envelope may be fabricated, plus all interior walls and the placement of amenities such as doors and windows. In this embodiment, the method starts generally from the outermost element of the envelope, i.e. the FOS, and then proceeds down and inward. The FOS is used to suspend multiple other elements such as exterior walls, interior walls, gable end walls, rake walls, doors, windows, etc., thereby eliminating all supports and braces that were previously required. And as already discussed this method, which is to say product, does not require extra labor to provide chases for plumbing or wiring exterior walls, interior walls, gable end walls, rake walls, doors, windows, etc. as examples.

Figure 9:
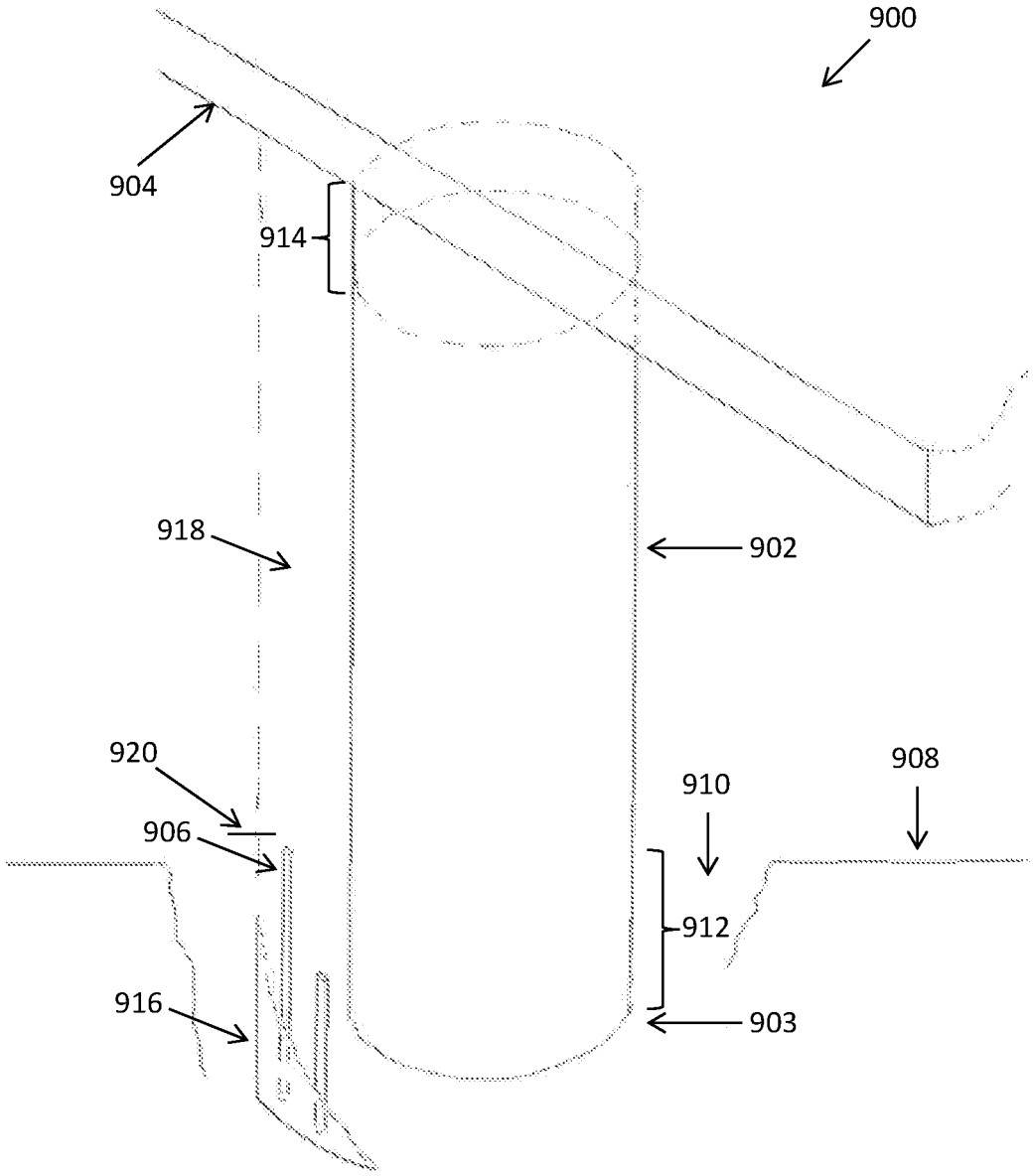
FIG. 9 is a perspective drawing illustrating another embodiment of the method of making a structure.

FIG. 9 illustrates another embodiment of the method 900. In this embodiment, the flexible net 902 may be provided in a tubular configuration. The lower end 903 of the flexible net 902 may be closed, similar to a sock, or open. In an embodiment, a flexible net is supported from above from an overhead structure 904, such as an overpass or bridge and then fixed to form a fixed flexible net 902 which may also function as a mold or form. Optionally, a non-porous flexible net 902 can have both ends closed which allows the net/flexible sheet, 902 to be inflated which forces the tube 902 into a true circular or cylindrical shape prior to fixing. In an embodiment, the lower end 903 of the flexible net 902 contacts the level below, such as the ground 908. In an embodiment, the flexible net 902 extends into a hole 910 in the ground. The hole 910 may be wider than the fixed flexible net 902 and may be provided with gravel, concrete, NUROC, or any other suitable material to support a lower portion 912 of the net 902. Optionally, reinforcing structures 906, such as rebar, may be provided in the hole to further provide support to the lower portion 912 of the fixed flexible net 902. In an embodiment, the interior of the cylinder formed by the fixed or unfixed flexible net 902 may be filled with any flowable fixable material such as NUROC (a visco-elastomeric polymer that may also comprise raw bulk materials thus yielding a concrete which by definition is a binder, or cement, that is mixed with additional bulk filler materials). In an embodiment, the flowable, fixable material may be expanded with air.

In an embodiment, an upper portion 914 of the flexible net may be shielded or otherwise left without fixative so as to function as a final adjustment point or hinge. The hinge may then be fixed if desired. The hinge allows the fixed flexible net 902 to be adjusted before final fixing and optional filling of the interior of the cylinder. Further, any additional reinforcement can be added on either, or both, the inside or outside of 902 fabric by suspending the fabric 902 from the overhead structure, prior to application of the fixative and/or the filling of the fabric 902 with flowable materials which may also fix the fabric 902. Optionally additional reinforcement can be provided on either side of fabric 902 after fixing the fabric 902 and suspended therefrom, or alternately from the overhead support such as a bridge component or other assembly that occupies a higher level or elevation than the fabric to be fixed.

In an embodiment, filling the interior of the cylinder formed by the flexible net 902 may be filled with a flowable material. The flowable material may be expanded with air which forces the flexible net into a circular shape (utilizing gravity), which places the flexible net 902 solely in a tensile load bearing configuration. No additional bracing or formwork is required, without regard to diameter or hydrostatic head load as long as the tensile capacity of the fixed flexible net 902 is adequate. It may be desirable to apply an overcoating material to the net 902 before or after the net 902 is filled with flowable material. In another embodiment, reinforcing materials, such as rebar, may be installed in the core area of the net 902 prior to filling, or alternately on either, or both, exterior and interior sides, of the net 902 prior to filling or overcoating the net 902. As already disclosed the term net is interchangeable with fabric and may or may not be porous.

In an alternative embodiment, a second tubular flexible net is supported from above and fixed to form a second fixed flexible net 916. In an embodiment, the second fixed flexible net 916 is configured concentrically around the first fixed flexible net 902. This net may also be supported at intermediate points if desired. Optionally, the second flexible net 916 may be hung and fixed prior to forming the first fixed flexible net 902. In an embodiment, the cavity 918 formed between the first flexible net 902 and second fixed or unfixed flexible net 916 may be filled with a flowable fixative. Optionally, reinforcing structures 906, such as rebar, may be provided in the cavity 918. As previously taught, the shape of the second fabric 916 can be provided by introduction of a flowable fixative into the void between the first fixed flexible net 902 and the second fabric 916 or by any other convenient means which may or may not result in a different shape.

In an embodiment, the second flexible net 916 extends from the ground up a specified distance to provide an increased diameter, thus a larger footprint. After the void 918 may be filled with, as an example, flowable load bearing material to support the load transferred down through the column. In the case where second flexible net 916 is hung prior to the first fixed flexible net 902, the first fixed flexible net 902 can be filled with a flowable material, or inflated as taught above, to provide a larger diameter footing or load bearing surface between the first fixed flexible net 902 and the ground 908. Alternately, the net to be fixed for this circular column can be shaped by entrapped air, flowable material or any other convenient means and then lifted from above, incrementally, a section at a time if desired. This increased footprint or bearing surface can be referred to as a 'footing' or 'spread footing'. This second net 916 may also supported from above via tensile load bearing supports attached to an overhead structure such as overhead structure 904, the overhead portion of fixed flexible net 902, or any convenient means of suspending the lower second net from above while the void created is being filled, and/or the net is being fixed. Appropriate rebar and/or other reinforcement including visco-elastomeric reinforcing nets, rebar, etc., which may or may not comprise basalt filaments, may be required to facilitate the integrity of the combined structure i.e. fixed flexible net 902 and fixed flexible net (footing) 916 with load bearing filler 918, and load transfer capacity of the connection between the fixed flexible net 902 and the second fixed flexible net (footing) 916. Alternately, in the case where 916 surrounds all, or part of the total height of the fixed flexible net 902; a third net (not shown) can pursuant to the teachings already set forth, be utilized to increase the size of the footprint i.e. act as a footing, at the bottom of this composite column of the fixed flexible net 902 and the second fixed flexible net 916. As disclosed above, this additional fabric with appropriate load bearing filler materials and reinforcements may again function as a spread footing to support the loads transferred through the column pursuant to the teachings set forth when the second fabric 916 is utilized to function as the footing. In this embodiment, the third fixed net (not shown) provides the increased bearing area to function as a spread footing under the column pursuant to the teachings of the second net when thus utilized. Note that any number of fabric layers, with or without fillers, may be utilized as desired. Large scale infrastructure projects are more efficiently constructed in accordance with this invention. It is important to note that in the case of infrastructure such as roads and bridges; the existing deteriorating and failing structures can be rehabilitated without the need of demolishing same. This saves not only the time and cost of demolition but very importantly eliminates the cost of loading, hauling, and disposing of the demolition debris. Further, large scale utility infrastructure projects such as dams for hydroelectricity as well as wind turbine tower construction and/or rehabilitation are benefitted by these teachings. Also note that even turbine blade replacement, due to failures, can be efficiently eliminated by this invention.

FIG. 10 illustrates another method 1000 according to an embodiment. In this method, a folded plate 1002 is formed by any convenient method. An end of the folded plate 1002 may be lifted and placed against an upper edge 1003 of a support 1008. Alternately, the forms, visco-elastomeric tensile/compressive load bearing materials, or poles creating the folded plate shape may be supported by edge 1003. The folded plate 1002 may then be slid such that a portion 1004 of the folded plate 1002 is above the upper edge 1003. Then the folded plate 1002 can be rotated, e.g. to desired orientation, and fixed to the top surface 1010, and/or edge 1003, of the support 1008. This provides a folded plate 1002 that can optionally have a cantilevered portion 1006 which can be of any desired remaining portion of 1002. By sliding and rotating, only about 50% of the weight of the folded plate 1002 is lifted to place the folded plate 1002 in the desired position at the second level when the formation of folded plate 1002 was done with at least a portion of the folded plate resting on edge 1003. Alternately, the folded plate can be rotated in the opposite direction into a substantially vertical orientation providing a wall or reinforcement for an existing wall.

As discussed above, any height of wall is easily accommodated by raising the FOS. This feature may be particularly effective in the case of the conical roofed structures that follow.

The method discussed above may be applied to the construction of conical roofed structures 1200 and other shaped roof assemblies as follows. As illustrated in FIGS. 12A-12C, a conical and other roof shapes can be efficiently fabricated out of net and fixative in the following manner. A tensile load bearing net is spread out on a surface such as the ground. Prior to laying the net down, a layer such as plastic/polyethylene sheeting (7 to 10 mil thickness has proven to be very effective), or other material may first be spread out in the desired location. Depending on the mix design of the fixative, this first layer of sheeting might optionally be treated with a mold release agent to avoid bonding to the surface below. However, in some cases a non-porous material or fabric would not require a mold release or barrier to separate it from the underlying sheeting or surface while being fixed or treated.

The tensile load bearing net can be cut in a desired shape, such as circular, and size before it is spread out on the ground or other surface. Next, sized and shaped 'shielding' materials 24, e.g. triangular, are provided and placed to shield off, or shield some sections of the net from the fixative. Thus, shielding 24 is defined as preventing or blocking the fixative from contacting or treating the shielded portion 7-12 of the net. In an embodiment, these triangular shaped shielding materials 24 are spaced apart in a predominately circular array, or pattern, with the apex of each triangle toward the center of the tensile net to be fixed. The opposite or base of the triangles are located toward the outside edge or periphery of the net to be fixed. The spacing of the shielded off, or shielded triangles 7-12 provides an alternating pattern of exposed triangular areas 1-6 of net to be fixed, separated by the triangular areas 7-12 that are shielded from being fixed. After the exposed triangular sections 1-6 are fixed the shielding 24 is removed from the shielded triangular sections 7-12. Alternately, shielding or shielding materials 24 that are flexible can be left in place.

The partially fixed net can now be lifted vertically from a point in the center 22 of the converging apexes of the fixed triangular portions 1-6. As the fixed triangles 1-6 are raised vertically, as an example, on a single, substantially centered, vertical support pole 20*a*, the non-fixed flexible net areas 7-12 naturally collapse upon themselves as the outer circumference of the fixed triangular sections 1-6 draws inward toward the center under the force of gravity or other forces. For example, in some cases with less flexible materials, it is advantageous to augment the natural tendency of the unfixed net to collapse under the force of gravity with mechanical fixtures or manual assistance or by placing a weight, such as a piece of rebar 20*b* in the center of the non-fixed flexible areas 7-12. The single center vertical support pole 20*a* may be placed through a hole in the center of the circular net 22.

When the center point, or point of converging apexes has been raised to an appropriate height, all of the fixed triangular sections 1-6 will almost be in communication with each other as illustrated in FIG. 12C. That is, both sides of the fixed triangles emanating from the apex will be touching, or close thereto, the adjacent fixed triangular section along their respective lengths from the center to the outside or periphery as desired. In an embodiment, this naturally occurs under the force of gravity as the converging triangle apexes are being lifted to the point of convergence, thus causing the fixed triangular sections to be drawn in and collapse against each other while the unfixed fabric sections fold or collapse under and between the fixed triangles as depicted FIG. 12B. At this time the contiguous fixed edges, as well as hanging unfixed portions, of net can be fixed in place. The size of the unfixed portions 7-12 of the net in FIG. 11B are exaggerated and for illustration only. Thus, a conical, or substantially rounded, shape can be achieved out of multiple fixed triangular shaped sections 1-12. As should be apparent flat fixed sections may yield a conical roof shape 1200 that is comprised of those flat segments 1-12. Alternately, fixed sections that have a curvature may be used to yield a smooth surfaced shape, such as a cone shape.

The individual fixed triangular shaped sections 1-6 may now be mechanically bonded to each other along the length of the two sides of the triangle that emanate from the apex. This can be achieved by placing a flexible piece of tensile load bearing net material (not shown) over the juncture or interface of two fixed triangles 1-6 and applying fixative thereto. Or, as previously taught, a coating of visco-elastomeric material or composite material can be applied. With or without the utilization of the overlapping tensile net, the application of the fixative can provide a load bearing covalent bond between the fixed triangular roof sections 1-6 effectively making the conical shaped roof structure 1200 one monolithically reinforced element.

The un-fixed portions of the flexible net 7-12 that had been shielded from the fixative naturally collapse upon themselves below the converging fixed sections 1-6 as they are lifted at the apex, collapsing inwardly around the periphery, also under the force of gravity (as an example). These un-fixed portions of flexible net sections 7-12 are now left hanging below the conical roof 1200 in an array emanating from the apex of the conical roof 1200. The unfixed sections 7-12 of net, radiating from the roof center or apex, can now be fixed in a substantially vertical orientation, or gravity dictated orientation, to provide depth of beam (i.e. increased) load bearing characteristics to the span of the roof 1200. Alternately, the unfixed sections 7-12 of net or other desired materials can have additional layers of net, or reinforcing bar, added before or after the initial fixative is applied to them or they can be easily removed. Additional reinforcement can be bonded to the previous layer by additional fixative or by any convenient method. These additional load bearing roof beams are fabricated in situ without any ancillary framework, supports, or molds of any kind. Again, the prior art has never fabricated reinforced cementitious load bearing roof beams or purlins in a substantially horizontal or sloped orientation under an existing roof without forms or molds with requisite supporting framework.

The method of collapsing, bending and hinging a specified length of unfixed flexible net (between fixed nets) along a hinge seam can be applied to the creation of purlins or beams under a conventional flat roof or overhead floor. Further, the ability to bend, hinge or rotate a specified width of net along one or both sides of the vertical net to be fixed can provide a beam or depth of member in the opposite direction. Further, a central width, or edge strip, of net can be shielded, and then collapsed upon itself, bent or rotated to provide centrally located depth of member(s) analogous to an intermittent "fan-fold" (FIGS. 6 and 7) on either side as desired, as well as beam(s) along the edge of the net as is desired.

Similarly in another embodiment illustrated in FIGS. 1A and 5A, horizontal (FIG. 1A), or vertical (FIG. 5A), wall purlins in a continuous sequential vertical wall fabrication can be accomplished simply by allowing a predetermined amount of shielded flexible net, from the roll, to collapse or bend at the interface between two sequential sections to be fixed and lifted either by the FOS being raised or alternately, the fixed net being raised by any convenient means, such as a via a rope and pulley system, from the FOS which is already elevated. This embodiment of the method, as those described above, including the now elevated FOS, can be all accomplished from the ground or the lowest gravity dictated level, if desired.

In an alternative embodiment, any size of building, without limitation in length or width, and without limitation in height or the number floors, can also be constructed with as few as one 16 ft. long support, or two 8 ft. long supports. As an example and without limitation, the supports can comprise dimensional lumber such as a 2×4, or metal pipe, bamboo or any material that can be conveniently handled and has sufficient compressive load bearing characteristics such as 450 to 1,000 psi, or in the case of steel up to 20,000 psi, or even greater load bearing capacity in the preferred embodiment utilizing visco-elastomeric polymer materials and composites that can yield up to 29,000 tensile and/or compressive load bearing capacities. The supports or temporary bracing can be removed and re-used almost immediately after the first 8 ft.×8 ft. vertically supported net, as an example, is fixed and left in a vertical position. Alternately, a flexible element such as a rope or cable can also be utilized to temporarily support the upper edge of the flexible net while it is being fixed. Alternately, only the net comprising visco-elastomeric materials has true tensile loading capacity as discussed. A cable might also extend beyond the posts and angled down to the ground to be used as additional support to hold the two posts in a vertical position.

In another embodiment, after the first net is fixed, the horizontal supports may be moved and reused. The first FOS of this structure can be fabricated by hanging and fixing a net that is supported along the top of the first 8'×8' fixed vertical wall. After the net is fixed and rotated into a horizontal or substantially horizontal position of the desired pitch, at least one of the 8' long supports, idled as soon as the first net fixative hardened adequately, may be used to support the end just rotated up into a substantially horizontal position. More nets are now hung and fixed, as desired, from this first FOS. These fixed nets can remain in their vertical orientation after being fixed or alternately any number can be rotated into a substantially horizontal orientation, or any desired orientation or position and braced with any supports now idle, if desired. Alternately, at least one of the fixed nets could have been rotated 180° into a substantially vertical orientation. This vertical element is at the 'second level' of the structure and can now be held in position with rope or cable or other suitable material and also suspend at least one FOSP as it is rotated into a substantially horizontal orientation. Thus, at least one FOSP can be supported in a substantially horizontal orientation without any of the auxiliary compressive load bearing supports. In these ways, the dimensions of the FOS can be expanded or extended without limitation and without additional or auxiliary supports.

Further, this sequence of construction can continue vertically by constructing yet more levels, one upon the other, in the manner described. In this embodiment of the method, any size of structure can be constructed 'from the ground' or 'floor' and without limitation to the number of floors to be constructed and while minimizing the jeopardy of workers with the inherent risks of working off the ground, i.e. utilizing ladders, scaffolding, forklifts, telescoping manlifts, cranes etc. Thus, the constructors never work more than a foot or two beyond their reach, always standing on the lowest gravity dictated level whether that be the ground or additional floors, or levels, until the last FOS serves as the roof or top most level. 'Reach' is defined as the distance that a man or machine can 'reach' out, or extend the working function horizontally, or vertically, from a given position.

This embodiment of construction practice, design, and materials for quickly fabricating structures of any size can be compliant with e.g. building codes, especially reinforced concrete building codes (International Building Code and ACI Code/American Concrete Institute Code).

Further, as discussed above, purlins or bracing may be built into the net prior to it being fixed or after it is fixed and rotated as describe above. The sequential construction of sections of floor or roof allow workmen to work on top of that specific level to add additional layers such as folded plate, non-linear reinforcing bar, foamed cementitious material, insulation or other reinforcements to fabricate an intermediate layer and also another fixed net layer overlying this intermediate layer if desired or required to bear ultimate loads as specified by engineers and building codes. In this way, any load bearing capacity for practically limitless spans can be accommodated within this invention. After the floor or roof sections have the added layer or layers comprising, as an example and without limitation, the characteristics of an exoskeleton, the floor or roof, now has adequate depth of member to have any temporary supports removed. This applies to at least total spans between load bearing walls and cantilever applications. As an example, a roof spanning up to at least 200 feet could be constructed in this manner and not require any auxiliary supports under it, excepting the walls at the ends of the roof, after completion of the construction methodology just described.

A conical roof assembly can be of any span or diameter, pursuant to the methods already taught relating to roof fabrication of unlimited dimensions.

As illustrated in FIG. 12B, the roof assembly can be raised on a single center pole 20*a* that runs vertically through a hole 22 in the roof net. The hole 22 may be located at the central point of convergence of the fixed triangles or conical roof apex. When the desired height is attained, the exterior wall nets, the interior wall nets, the interior and exterior doors, the windows, and any other such amenities can be suspended directly from the conical roof, or indirectly via suspended nets or other tensile load bearing materials and fixed in situ. Thus, in this embodiment, only one centrally located vertical support pole is used. That is, no horizontal supports or auxiliary vertical supports with the exception of the one central pole is used to fabricate an entire house or structure envelope. Additionally, interior walls, doors, windows, etc. may be positioned and fixed in place pursuant to these embodiments without supports. That is, the structure may be fabricated from the roof inward without the requirement of any other supports, braces, or molds. Further the roof, the walls, or other substantially vertically suspended building components and assemblies, may be fabricated from ground level which is to say within the reach of the constructor standing on that lowest gravity dictated level without the need for ladders, scaffolding, man lifts, etc.

The fixed nets and methods discussed above comprise tensile load bearing fabrics or nets that are fixed with a compressive load bearing material. In a preferred embodiment, the compressive load bearing fixative or binder can also have tensile load bearing capacity of from 200 to 300 psi or such as 300 to 29,000 psi, while the compressive load bearing capacity ranges from 200 to 300 psi or from 300 to 29,000 psi. In an embodiment, the covalent bonding fixative may comprise fibers, or other formations, of load bearing materials. "Load bearing material or structure" is defined as that material or structure having the capacity to resist, support, hold, or bear loads applied pursuant to the design load requirements of that building or structure without failure which is defined as the inability to maintain the pre-determined shape within acceptable tolerances. Acceptable tolerances are defined as those tolerances e.g. amount of movement, deflection, stretching, or compression of materials, as examples, that is within the structural design parameters as are known and practiced by structural engineers (and as codified in the International Building Code or relevant locally accepted code) and thus the load bearing capacities of the net fabric in combination with fixative can be predetermined wherein the structure, has the capacity to retain its shape and function within the pre-determined and specified limits while pre-determined loads are being applied.

The loads to be applied are typically predetermined by those skilled such as structural engineers. Because the tensile and compressive load bearing capacities of the net(s) and the fixative can be controlled and thus specified, the problem with limitations of load bearing capacities, spans, heights, widths, etc. can be efficiently overcome making various embodiments effectively or practically unlimited in load bearing capacity. "Practically" is defined herein as "at least equivalent to, or greater than, loads and spans in traditional construction".

Further, all teachings, layers, combined component layers, assemblies of same or any parts of same can all be utilized independently or in combination with any other teachings, other layers, combined composite layers, or assemblies which may or may not be finished assemblies. As well, all product shapes such as a single fixed layer, 3-layer exo-skeleton or folded plate with of without skins (as examples) can be utilized in any order or layer and combined to create any desired configuration.

The field of 3D construction and robotic construction technologies have historically faced insurmountable obstacles to overcome when attempting to fabricate large structures such as houses. As an example, 3D construction of houses cannot be done in situ because any horizontal load bearing element such as windows or door lintels/headers, floor sections, entire floors, roof sections, entire roofs etc. must be fabricated with the aid of some type of mold in which the continuous tensile load bearing element is embedded in the flowable compressive load bearing or cementitious material. This 'part' is then lifted from the mold after hardening and set in place as part of the 3D sequence of construction. Thus, this part cannot be fabricated in the position of final use without first constructing a mold which defeats the entire purpose of 3D construction.

One obstacle encountered in conventional construction is the inability to efficiently embed or place the tensile load bearing elements in the compressive load bearing fixative as is required by building codes in 'reinforced concrete' fabrication or construction of these load bearing structures. Load bearing structures are herein defined as having the capacity to bear imposed or applied compressive loads of 20-50,000 psi and tensile loads of 20 to 50,000 psi. However, the utilization of nets with fast gelling and setting proprietary fixative can be easily deployed and fixed robotically, within the methods set forth herein, providing the solution to this problem for the prior robotic construction art.

An embodiment of the method of construction provides for the robotic construction of single fixed net layers, or multiple fixed net layers, of any ultimate fixed size and shape without the limitations previously encountered due to the size and shape limitations of robotic construction or fabrication equipment. One of those limitations is the 'reach' or height-width-depth capacities of robotic machinery that has to be ever larger to accommodate larger structures. Another limitation includes accesses to construction sites with limited access for larger and larger fabrication equipment or machinery. Thus, as an example and without limitation, the apparatus (FIG. 8) for applying fixative to a net as the net is unrolled can be made mobile by mounting the apparatus to any convenient mobile equipment. Therefore, the limitations of reach, height, length, and breadth, are easily overcome. Thus, the robotic apparatus may never be required to extend further than is easily reached by a worker standing on the ground or on that next level of construction as taught herein.

Embodiments herein overcome the limitations, load bearing capacity problems, and building code compliance problems regarding cold joints, non-continuous tensile load bearing elements, etc. which are now stopping the robotics and 3-d construction industry from full scale, or large structure/house/bridge scale, construction. Further, and in the preferred embodiment, the utilization of visco-elastomeric fixatives that provide covalent bonding and fast gels and set of varied materials eliminates problems with cold joints, non-continuous tensile load bearing elements, and limitations from fixative set times. The preferred visco-elastomeric polymer fixative has a gel time of from 1 (one) minute to 8 (eight) hours and a set time of from 48 (forty eight) hours to 30 (thirty) days. Said set time yielding compressive load bearing capacities from combined visco-elastomeric polymer cement/binder, with or without any chosen aggregate(s) i.e. concrete, ranges from 10 psi to 10,000 psi, from 10,000 psi to 30,000 psi.

The tensile load bearing capacities of combined proprietary visco-elastomeric polymer cement/binder, with or without chosen aggregate(s) i.e. concrete, range from 10 psi to 10,000 psi, from 10,000 psi to 30,000 psi.

Alternately, set times can be in excess of 2 minutes, or in excess of 2 hours, when compressive load bearing requirements of 20-50,000 psi and tensile load bearing requirement of 20 to 50,000 psi are to be accommodated.

Embodiments of the invention allow the builder or robotic/3D equipment to construct any size building while standing on the ground, or first below gravity dictated level e.g. the builder is not by necessity required to utilize ladders, scaffolding, cranes, telescoping forklifts (as man lifts) to get to any height much greater than that of his physical 'reach' with the aid of appropriate hand held apparatus extensions such as handles, wands, etc. This includes the construction of floors and roofs that would normally be considered as 'overhead' construction requiring the aforementioned equipment to get the builder to this elevation that is beyond his reach while standing on the ground level i.e. physical elevation of work. This feature can now be employed by relatively small robotics equipment. As an example, the robotics, or '3D' construction, equipment no longer needs to have the height and 'reach' capacity to construct a large roof at roof height. A robotics machine can now fabricate the roof, of any dimension, from the ground level i.e. the roof is rotated into position from 'ground level' without the machinery ever fabricating any of it at the higher elevation dictated by the specified height of the roof. Alternately, as discussed above, the apparatus or "robotics machine" (FIG. 8) can be compact, mobile and weigh less than 500 pounds which would allow the apparatus to be utilized at or on the deck, floor, or roof regardless of height as previously taught herein.

Another embodiment as illustrated in FIG. 8 provides that a first robotically fixed net can be fixed as it comes off of the roll. The net is placed in whatever configuration or shape required within the predetermined and controlled set time of the fixative. Alternately the net can be placed and then robotically fixed. In some cases, the gel time may be within 1 to 2 minutes within the specifications of proprietary visco-elastomeric fixative and binders herein set forth. Optionally, the net does not need to be put into place of final use and fixed or fabricated in situ. The net is first coated/fixed and then placed into the position, configuration and orientation, of final use. This provides a method in which the robotics or 3D construction industry can now fabricate any size of structure without being limited by size, load lifting capacities, reach capacity or transport restrictions of the robotics or 3D equipment such as 3D gantries. Further, any height, width, depth, and load bearing capacity required can now be fabricated by small economical robotics equipment without limitation.

Substantially horizontal building components, such as long floor sections, long roof sections, and long bridge sections have historically and typically been prefabricated elsewhere (often times not at the site of the structure), typically in a mold if reinforced concrete, or in a steel plant if structural steel, and then lifted and placed into position of final use. Embodiments of the invention provide the ability whereby robotics can now fabricate such things as planar floors and decks, roofs, beams, lintels and other substantially horizontal surfaces and parts in situ and without the necessity of a mold. The prior robotics art must cast these cementitious building components in a mold elsewhere. This is particularly so for components that require continuous tensile load bearing materials. The precast parts are then lifted into place where they must now be mechanically fastened or attached to the contiguous building elements.

An embodiment eliminates the size limitations encountered in the known prior art robotics and '3D' construction industry. This may be accomplished by the use of tensile load bearing nets that can be fixed with an at least compressive load bearing flowable fixative or cementitious material, where the nets can be hung and fixed with relatively small robotics equipment moving independently in contrast to using a large 'gantry' or articulating arm as done by the prior art. The smaller, faster, more adaptable, and thus more economical robotic equipment is not limited to smaller structures. The smaller independent mobile robotics equipment having a footprint of from one sq. feet to 180 sq. feet can fix a specified size of tensile load bearing net at any one time and then adjust the orientation or placement as desired. Alternately, the net can be deployed and fixed continuously in the place of final use as shown in FIG. 8. The specified size may be up to the maximum size of roll that can be handled by the machine or equipment e.g. a roll of flexible net 3 feet wide, a net 40 feet wide, and of a length determined by the maximum diameter of rolled up netting that can be accommodated by the equipment, for example 600 lineal feet, or 2,000 lineal feet of fabric or net. However, even this limitation is eliminated by the binder set forth herein that eliminates cold joints and unnecessary splicing of fabrics.

Walls, floors, decks, roofs, and other such surfaces, can be constructed robotically with a compressive load bearing material combined with a tensile load bearing net that inherently provides continuous tensile load bearing capacity throughout the dimension of the net. This eliminates the problems that are commonly caused by traditional, known, construction methods and materials such as cold joints and non-continuous tensile elements in the compressive load bearing material. Further, the ease of utilizing 'shielded' or un-fixed areas of net as areas where another application of flexible load bearing net can be applied and fixed thereto accommodates any dimension, or load, without limitation even when known traditional load bearing fixatives and materials are utilized.

In an embodiment, a FOS configured as a folded plate can be fabricated from the 'ground level' by fixing the net while in a vertical, or substantially vertical orientation, after the net has been reconfigured into a folded plate configuration by placing vertical supports on opposite extreme planes of the folded plate design to force the net into the desired folded plate configuration while being fixed. This is similar to the embodiment illustrated in FIG. 10 using the supports 106 illustrated in FIG. 1. After fixing the folded plate configuration, the vertically oriented supports can be removed and the folded plate section can be rotated into orientation of final use, or placed into position of final use, or alternately left in place if so desired; as already described. After being rotated, adjusted, or placed into the final position of use, the folded plate can similarly support all amenities and additional layers or shapes as discussed and without limitation, for the rotated flat planar methodology. In an embodiment, at least one substantially planar net could be fixed to one or both sides of the folded plate at any time after the net is fixed in the folded plate configuration.

Alternately, the formation of the folded plate sections for any orientation can be accomplished by positioning the tensile load bearing flexible net against a removable appliance, or form, having the desired folded plate shape and then forming a vacuum between the form and the net which pulls the substantially non-porous fabric into the desired shape. This embodiment of the method is not limited to folded plates and may be used to form any desired shape such as purlins or other parts. Optionally, a slow setting fixative or flexible overcoat may be applied to a porous or open weave net to facilitate conformation of the net to the form in the vacuum process prior to the fixative/overcoat hardening. In an embodiment, the fixative is applied to the flexible net before the flexible net is pulled into the desired shape. This is because the open weave, or configuration of porous nets inherently allow air to easily pass through them which negates a vacuum being pulled. Thus, the fixative preferably has an accurately controlled and short set time to utilize this method to produce a folded product.

Set time, cure time, or hardening is defined as that period of time that passes in which the fixative goes from a liquid flowable state to a non-flowable gelled state and ultimately to a fully cured state. Set times of proprietary binders might be controlled to within 20 seconds and possess a short 'gel' time, such as under 1 minute, such as under 3 minutes, to allow for product and methodology efficiencies. "Gelled" is defined as the ability to take an initial level of set that allows removal or manipulation of the part without damage. In an embodiment the fixative does not require mold or form release. Alternately, after application of either a net pre-coating stiffener, overcoat, or the fixative with specified set times in combination with an airtight membrane on the net side opposite of the vacuum, such as a flexible drapable plastic sheeting, the vacuum can be effectively pulled utilizing porous fabrics. This membrane may or may not be removed after the vacuum forces the load bearing net into a desired shape and the fixative has hardened. Then, the desired shape can be left in position, or in situ, or alternately rotated into any other orientation, or placed in another location as taught herein. In some embodiments, the binder or fixative eliminates the need for a porous, or net type fabric. Thus, a solid non-porous flexible drapable tensile load bearing fabric, or 'net', can be utilized.

Another embodiment of the method includes forming a folded plate for substantially vertical applications, with combinations of angles at top of peak and catenary curve at bottom of trough, or catenary curve at both top and bottom. In this embodiment, one end of substantially horizontal folded plate supports are hung or supported by the FOS or the edge 1003 FIG. 10; the other ends may be supported in any convenient way. After draping the net from one support to the next, the net can be fixed with catenary troughs at the bottom and peaks formed by the first set of supports at the top. Alternately another set of lower supports may be added as discussed above to yield a folded plate structure.

In another embodiment, 'rounded' or 'round shaped' upper supports are supplied which, when combined with round lower supports, or just the gravity dictated catenary curve, yield a 'sine curve' shape or end profile. After any of these initial forming and fixing methods is utilized, temporary supports can be removed if desired and the gravity dictated folded plate section or panel can be rotated into a vertical (wall, barrier, etc.) orientation, or a substantially vertical orientation. This embodiment of the method of forming a folded plate or similar shape eliminates at least half the supports used in the prior art. "Substantially" vertical or horizontal is defined as less than 45 degrees, such as less than 10 degrees, such as less than 5 degrees, such as less than 1 degree off of either vertical or horizontal designation as applicable.

FIGS. 13A-13E and 14I illustrate basalt rebar 1300 according to various embodiments. In the embodiments illustrated in FIGS. 13A, 13D, 13E and 14I, the basalt rebar 1300 includes multiple basalt filaments 1302 embedded in a fixative 1304. Several of the embodiments include indentations 1306 which may be made, for example, by compression. Indentations 1306 improve the mechanical attachment between the basalt filaments 1302 and the fixative 1304. The embodiments illustrated in FIGS. 13B and 13C are single filaments 1302. These embodiments may also include indentations 1306 (FIG. 13B) or kinks (FIG. 13C). The embodiment illustrated in FIG. 14I may include chopped flexible filaments, such as the embodiments of bent and/or kinked basalt fibers illustrated in FIGS. 14A-14H. As illustrated, the embodiment in FIG. 14I has a square cross section. However, the cross section may have any shape. Further, any component described above may be made with a fixative which includes any of the chopped filaments illustrated in FIGS. 14A-14H. As illustrated in FIGS. 14A-14H, the basalt fibers may be kinked, bent, flattened or formed into loops. The kink, bend, or loops may be formed when the basalt is in a malleable state and the kink, bend, or loops are permanent when the basalt is cooled.

Figure 15:
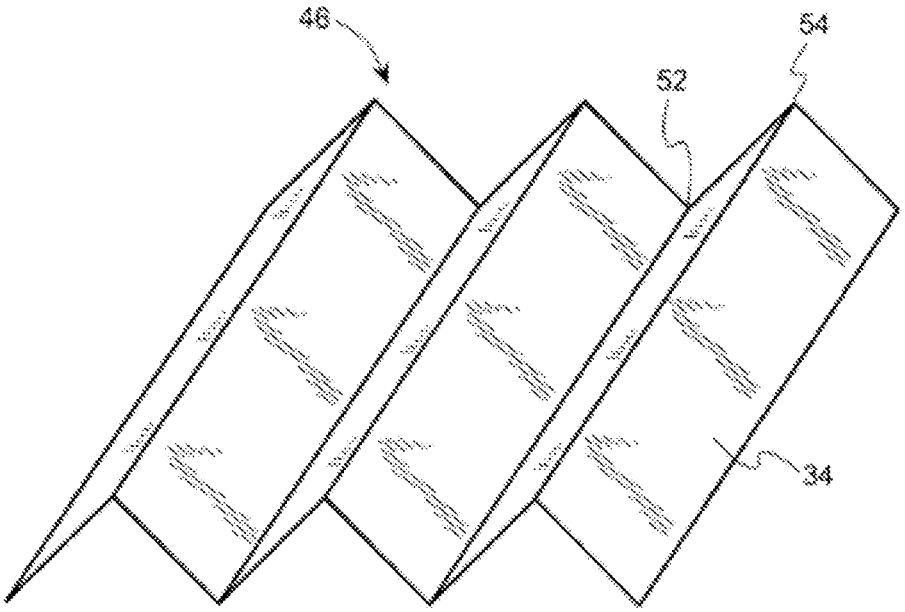
FIG. 15 is an isometric view of an embodiment of a fan-folded structure which may be used as a roof.

FIG. 15 shows a roof 46, with a connected series of flat roof segments at acute angles to one another defining troughs 52 and peaks 54. Thus, the rebar supports can serve as another variety of a temporary framework that holds a fabric or net in discipline or desired shape. Application of a single layer of net and a layer of cementitious material 34 can complete the roof structure. Alternatively, the roof 46 of FIG. 16 may serve as a mold that allows application of one or more additional layers of net 32 and fixative material 34.

Figure 16:
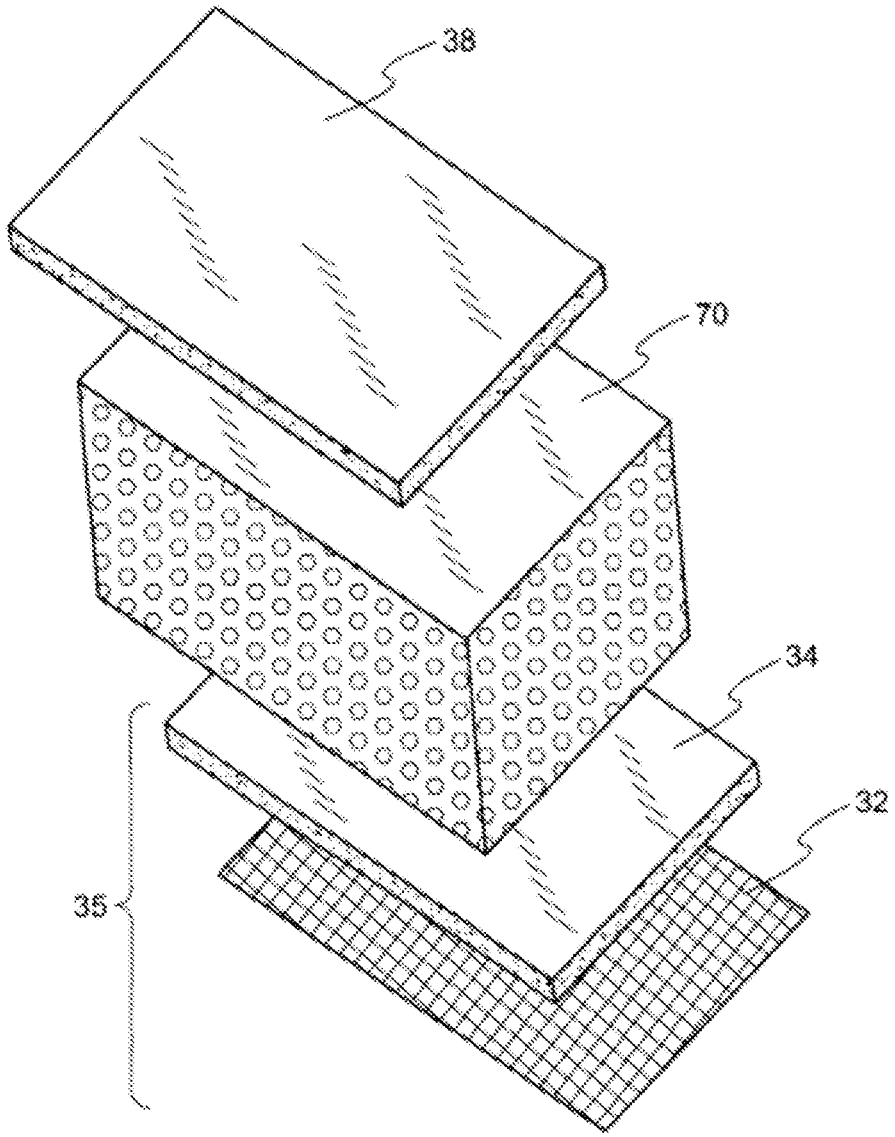
FIG. 16 is an isometric assembly view showing layers of any embodiment component of building construction.

As shown in FIG. 16, a polymeric, cementitious, or other hard setting principal layer 34 is applied over the net 32. Cementitious materials include Portland cement and materials sharing similar chemistry of hydration. Other cementitious materials include geopolymers that are formed by the chemistry of polycondensation. Typically, the principal hardening layer 34 will penetrate and bond with the net layer 32 such that the net is not removable. Suitable materials for use in the principal hardening layer 34 will cure or set by passage of time or other methods. Both slow setting and fast setting materials are known. Accelerators may be used as desired. A suitable set time might range from several seconds to several hours.

A shell 40 or other component of a building formed according to the invention may constitute an exoskeleton assembly. The hardened layer 34 defines a first external structural skin of the exoskeleton assembly. Preferably, a second external structural skin is added, consisting of at least the second hardened layer 38. In the case of compressive shapes such as vaults or domes, the inner layer 34 need add little or no structural capacity—it simply may act as a mold.

Principal hardened layer 34 may contain fibers that impart structural characteristics to the layer. Other optional ingredients include silica fume, plasticizers, or micro fibers added to the cementitious mix design. Suitable components for inclusion in the mix design are ceramic spheres, which may be synthetic or natural as present in some ashes; polymers; corn or corn derivatives, which may be by-products of processing; magnesium, such as magnesium oxides; phosphates; micro fibers, which may include round or ring shaped fibers; recyclable wastes; and other processed waste materials including phosphogypsum and mine or mill tailings. Other suitable additions include air or other materials among which may be: cements; synthetic or natural ceramic spheres; expanded polystyrene (EPS); soils; polymers; plasticizers; gelling additives; ashes such as of coal ash, rice hull ash, corn ash, bagasse ash, volcanic ash, or others; pumice; magnesium oxides; phosphates; fine powders such as calcium carbonate, waste gypsum or phosphogypsum, mine or mill tailings; and processed recyclable wastes.

Figure 17:
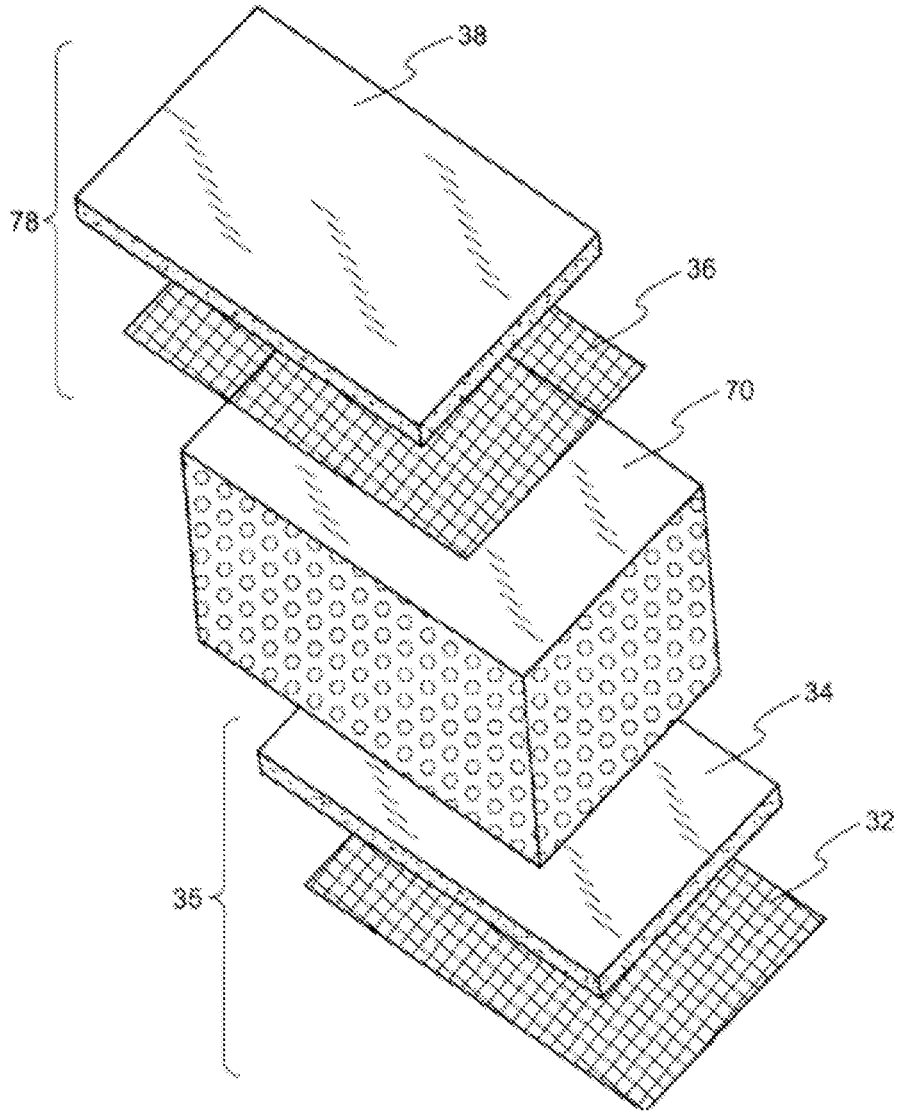
FIG. 17 is an isometric assembly view showing layers of any component of a building construction according to an alternate embodiment.

In addition to layers of netting and principal hardening materials applied to the netting, an exoskeleton building construction should include one or more additional intermediate layers 70, shown in FIGS. 16 and 17, which may be a filler layer, a strengthening layer, or an insulating layer. A base layer, skin, or shell wall 35 acts as a backer board or mold to accept and provide shape or control for the applied layer 70. Among suitable methods for applying layer 70 are pneumatic application, spraying, and pumping. Layer 70 may be stacked on or against a base layer 35, using a minimal slump mix design. With a troughed roof 46, layer 70 may fill the troughs to establish a smooth or flat roof, which then can be coated with an external finishing layer 35, 78.

Where layer 70 is applied to add spacing or depth to a building structure, layer 70 may be formed of honeycomb material that provides depth of structural element or beam. Optionally layer 70 is composed of expanded cementitious materials, for example expanded by air. The material forming the layer 70 may contain air or other materials among which may be: cements; geopolymers; synthetic or natural ceramic spheres; expanded polystyrene (EPS); soils; polymers; plasticizers; gelling additives; ashes such as of coal, rice hulls, corn, bagasse, volcanic, or others; pumice; magnesium oxides; phosphates; fine powders such as calcium carbonate, waste gypsum or phosphogypsum, mine or mill tailings; and processed recyclable wastes. Such materials may be used as a base raw material for a mix, or to expand a cementitious mix, regardless of whether they provide significant structural strength. The materials may have inherent compressive and tensile characteristics by themselves. The composition of layer 70 may offer insulating values to the building structure.

For economic and environmental advantage, layers 34, 38, and 70 may be fabricated from indigenous, low cost or freely obtainable materials, especially recyclable materials. Certain suitable materials may be an environmental liability to others. After such materials are detoxified, they form suitable components for use in the invention and need not be buried or otherwise stored. Some of the materials otherwise must be sent to landfill or disposed of in a manner that incurs costs. The ability to make beneficial use of such materials creates a profit center. The materials chosen are selected for utility in the invention and not on the basis of whether they are recognized by building codes or engineering standards. Likewise, it is optional whether such materials contribute significant compressive or tensile strengths.

In FIGS. 16 and 17 a hardened second layer 38 covers layer 70. This layer is an outer structural shell or skin of an exoskeleton assembly. Layer 70 provides depth of beam or strength by increasing the space or moment of inertia for exterior exoskeleton skins in the wall, floor, or roof. Layer 70 may be formulated to provide insulation. Where several layers of the assembly are built up, layer 38 may be the exterior skin or finish coat of the built up assembly. Components of layer 38 may include ceramic sphere admixtures that impart qualities of an effective sound barrier and a high level of emissivity or reflectivity to the material. Corn-derived admixtures are desirable to impart a high level of emissivity, reflectivity, or thermally non-conductive characteristics to the material. Fibers can impart structural characteristics to the layer 38, adapting it as the final layer of an on-site, built up, and structural exoskeleton assembly.

As shown in FIG. 17, an additional layer of net or fabric 36 can be utilized in the outer layer or skin of the exoskeleton assembly. The layer 38 can be a hardening layer applied to the fabric 36 to form a combined layer 78. The qualities of the external layer can be chosen according to environmental constraints. For example, materials such as ceramic spheres, corn products, and gold are known to impart high reflectivity, which is beneficial to stop heat transfer. The inner layer 34 also can be adapted to local need according to the choice of added components.

The foregoing description of the invention has been presented for purposes of illustration and description. It is not intended to be exhaustive or to limit the invention to the precise form disclosed, and modifications and variations are possible in light of the above teachings or may be acquired from practice of the invention. The drawings and description were chosen in order to explain the principles of the invention and its practical application. However, variations of these principles are within the teachings and claims set forth. It is intended that the scope of the invention be defined by the claims appended hereto, and their equivalents.

What is claimed:

1. A method of fabricating a structure comprising:

hanging a flexible fabric in a substantially vertical orientation, wherein a first portion of the flexible fabric is supported by a compressive load bearing framework and a second portion of the flexible fabric hangs without any compressive load bearing framework engaged therewith and bears a tensile load;

shielding at least some of the first portion of the flexible fabric such that the second portion of the flexible fabric remains unshielded; and applying a fixative directly on the flexible fabric to the second portion, which is unshielded, wherein the fixative is configured to harden the second portion forming a fixed portion, wherein the shielding substantially blocks the first portion of the flexible fabric from receiving the fixative so that the first portion remains flexible and is configured to act as a hinge allowing the fixed portion to be rotated relative to the first portion.

2. The method of claim 1, further comprising rotating the fixed portion.

3. The method of claim 2, wherein the fixed portion is rotated into a non-vertical orientation.

4. The method of claim 3, wherein the fixed portion is rotated into a substantially horizontal orientation.

5. The method of claim 3, wherein the fixed portion is rotated approximately 180° to a substantially vertical orientation.

6. The method of claim 1, wherein fabricating the structure is performed from the top down and in situ without any compressive load bearing framework or supports including dimensional lumber, plywood, metal studs, steel beams, steel columns, or reinforced concrete.

7. The method of claim 1, wherein the structure comprises a foundation and the foundation is not the first element constructed.

8. The method of claim 1, wherein walls of the structure do not require a foundation for support while being constructed.

9. The method of claim 1, wherein any shape, or size of elevated floor, roof, or substantially horizontal structure can be fabricated without any auxiliary bracing, molds, framework, formwork, or compressive load bearing supports.

10. The method of claim 1, wherein a first overhead structure (FOS), or a single first overhead structure panel (FOSP), functions as the sole initial support for fabrication.

11. The method of claim 10, wherein any fabricated layer, FOS, or FOSP functions as a mold for more layers of flowable materials.

12. The method of claim 10, wherein the FOS is not required to have the ultimate design load bearing capacity to span between permanent supports.

13. The method of claim 10, wherein a finished FOS has a load bearing capacity to resist or bear ultimate design loads as required by span in combination with live and dead loading specifications.

14. The method of claim 1, further comprising using existing overhead assemblies to hang or support nets to be fixed in situ without molds or ancillary formwork, or reliance on initial support from the ground level.

15. The method of claim 1, further comprising providing reinforcement structures.

16. The method of claim 15, wherein the reinforcement structures comprise steel or basalt reinforcing bar, or more nets to be fixed.

17. The method of claim 16, wherein the basalt rebar and fixed net comprise a binder with set times of less than 5 minutes.

18. The method of claim 17, wherein the binder can be utilized as the only component for sizing, and gluing tensile load bearing filaments and fibers.

19. The method of claim 18, wherein the fibers comprise carbon fibers, glass fibers, basalt fibers, petro-chemical based fibers, graphene filaments or steel fibers together or in discipline.

20. The method of claim 16, wherein a binder produces a composite that is impermeable and not degraded by salts or acids.

21. The method of claim 16, wherein the basalt rebar and fabric comprise a binder having a working temperature from cryogenic up to 2,400 degrees F. without degradation of tensile and compressive load bearing characteristics.

22. The method of claim 16, wherein the basalt rebar and fixed net comprise a binder that produces a covalent bond with raw bulk materials, eliminating cold joints.

23. The method of claim 16, wherein the basalt rebar and fixed net comprise a binder that is thermally non-conductive up to 1600 degrees F.

24. The method of claim 16, wherein the basalt rebar and fixed net comprise a binder that remediates and sequesters toxins, acids, and materials contaminated with radio-active materials without leaching.

25. The method of claim 16, wherein the fixative comprises a binder with set times of 3 to 5 minutes.

26. The method of claim 16, wherein the fixative comprises a binder that can be mixed with raw bulk materials including dirty water, oil, mine and mill tailings, municipal waste streams, volcanic ash, coal ash, bagasse ash, soil, and yield 3,500 psi compressive strength with at least 30% air expansion.

27. The method of claim 16, wherein the fixative comprises a binder having a working temperature of from cryogenic up to 2,400 degrees F. without degradation of tensile and compressive load bearing characteristics.

28. The method of claim 16, wherein the fixative comprises a binder that produces a covalent bond.

29. The method of claim 16, wherein the fixative comprises a binder that can fix and harden inorganic and organic materials in a composite structure.

30. The method of claim 16 wherein the fixative comprises a binder that is thermally non-conductive up to 1600 degrees F.

31. The method of claim 16, wherein the fixative comprises a binder that remediates and sequesters toxins, acids, and radioactive materials without leaching.

32. The method of claim 15 wherein the fixative comprises a binder that eliminates cold joints.

33. The method of claim 15, wherein the reinforcement structures comprise foamed layer(s), layers comprising non-linear reinforcement or substantially planar layers.

34. The method of claim 33 wherein the substantially planar layers are fabricated monolithically with the fixed flexible fabric.

35. The method of claim 33, wherein the non-linear reinforcement is fabricated in situ while suspended at least partially in a vertical or horizontal position.

36. The method of claim 1, wherein a first overhead structure (FOS), or a single first overhead structure panel (FOSP), functions as a finished component or product.

37. The method of claim 1, further comprising doors or windows attached to at least one fixed net.

38. The method of claim 1, further comprising installing electrical and plumbing, wherein electrical and plumbing installing does not rely on any support from below a position of installation.

39. The method of claim 1, further comprising repeating the steps of hanging, shielding, and applying a fixative a plurality of times.

40. The method of claim 1, wherein any number of floors or levels, and any height of wall, can be fabricated without workers using ladders, scaffolding, telescoping forklifts, cranes, man-lifts, or heavy construction equipment.

41. The method of claim 1, further comprising monolithic support beams or purlins.

42. The method of claim 1, wherein the fixative does not cause distortion or deflection due to the weight of the fixative.

43. The method of claim 1, further comprising forming cantilevered floors or roofs in situ without auxiliary compressive load bearing supports, framework, formwork or molds.

44. The method of claim 1, wherein the structure comprises round walls or conical roofs fabricated without auxiliary molds or auxiliary supports.

45. The method of claim 1, further comprising fabricating a plurality of wall, roof or floor panels using a continuous uninterrupted flexible fabric, and continuous uninterrupted fixative.

46. The method of claim 45, wherein the flexible fabric is longer than the fixed fabric portion to be rotated or lifted.

47. The method of claim 1, wherein two workers, without heavy equipment and in situ, can produce 180 to 1,920 sq. ft. of substantially vertical or horizontal structure comprising walls or elevated floors in one hour.

48. The method of claim 1, wherein the flexible fabric comprises a cylinder.

49. The method of claim 48, further comprising hanging a second cylindrical flexible fabric concentric with a first flexible fabric.

50. The method of claim 49, further comprising filling a gap between the concentric first and second cylindrical fabrics with a compressive load bearing material.

51. The method of claim 50, further comprising providing reinforcement structures in the gap between the concentric flexible fabrics.

52. The method of claim 1, wherein hanging the flexible fabric, shielding a portion of the flexible fabric and applying a fixative are performed by one or more robots.

53. A structure made by the method of claim 1.

* * * * *